United States Patent [19]

Kane

[11] Patent Number: 5,029,819

[45] Date of Patent: Jul. 9, 1991

[54] HANDLING AND SUPPORTING FLEXIBLE MATERIAL OF A FENCE

[76] Inventor: Phillip J. Kane, 3 Edwards Street, Liverpool, NSW, 2170, Australia

[21] Appl. No.: 381,683

[22] PCT Filed: Dec. 18, 1987

[86] PCT No.: PCT/AU87/00431

§ 371 Date: Jun. 18, 1989

§ 102(e) Date: Jun. 18, 1989

[87] PCT Pub. No.: WO88/04715

PCT Pub. Date: Jun. 30, 1988

[30] Foreign Application Priority Data

Dec. 18, 1986 [AU] Australia ..... PH9557

[51] Int. Cl.[5] ..... F04H 17/16

[52] U.S. Cl. ..... 256/24; 256/12.5; 256/32

[58] Field of Search ..... 256/24, 23, 25, 73, 256/40, 32, 12.5, 19, 37, 45, 47, 52

[56] References Cited

U.S. PATENT DOCUMENTS

| | | | |
|---|---|---|---|
| 2,753,156 | 7/1956 | Rieger | 256/12.5 |
| 2,803,437 | 8/1957 | Borges | 256/12.5 |
| 2,872,161 | 2/1959 | Olson | 256/24 |
| 2,914,270 | 11/1959 | Parker et al. . | |
| 3,347,527 | 10/1967 | Andrews | 256/24 X |
| 3,913,889 | 10/1975 | Nugent et al. | 256/32 X |
| 4,124,196 | 11/1978 | Hipskind . | |
| 4,186,912 | 2/1980 | Byrd, Jr. | 256/24 X |
| 4,287,637 | 9/1981 | Bernardi . | |
| 4,576,364 | 3/1986 | O'Fearna | 256/24 |
| 4,756,511 | 7/1988 | Wright, III | 256/12.5 |

FOREIGN PATENT DOCUMENTS

| | | |
|---|---|---|
| 1054105 | 4/1959 | Fed. Rep. of Germany . |
| 2142162 | 3/1973 | Fed. Rep. of Germany . |
| 1523376 | 5/1968 | France . |
| 2080011 | 11/1971 | France . |
| 2080012 | 11/1971 | France . |
| 2201698 | 4/1974 | France . |
| 2406695 | 5/1979 | France . |
| 2079966 | 11/1979 | France . |
| 2433090 | 3/1980 | France . |

*Primary Examiner*—Peter M. Cuomo

*Attorney, Agent, or Firm*—Stevens, Davis, Miller & Mosher

[57] ABSTRACT

A system for the handling and support of flexible material such as for the erection of barricades, fencing or shading comprises a roll of flexible material (20) e.g. brattice cloth or open plastics fabric held by a dispenser (24) having tubes (21) or straps regularly spaced along the material (20) allowing the securing of material by posts (27) to a support when the material (20) is unwound from the dispenser (24). The support may be a surface e.g. a roadway to form a barricade as shown or other structure e.g. to make a shade enclosure. A variety of accessories such as stands bracing or post extending components can also be used with the system to extend its functionality.

11 Claims, 28 Drawing Sheets

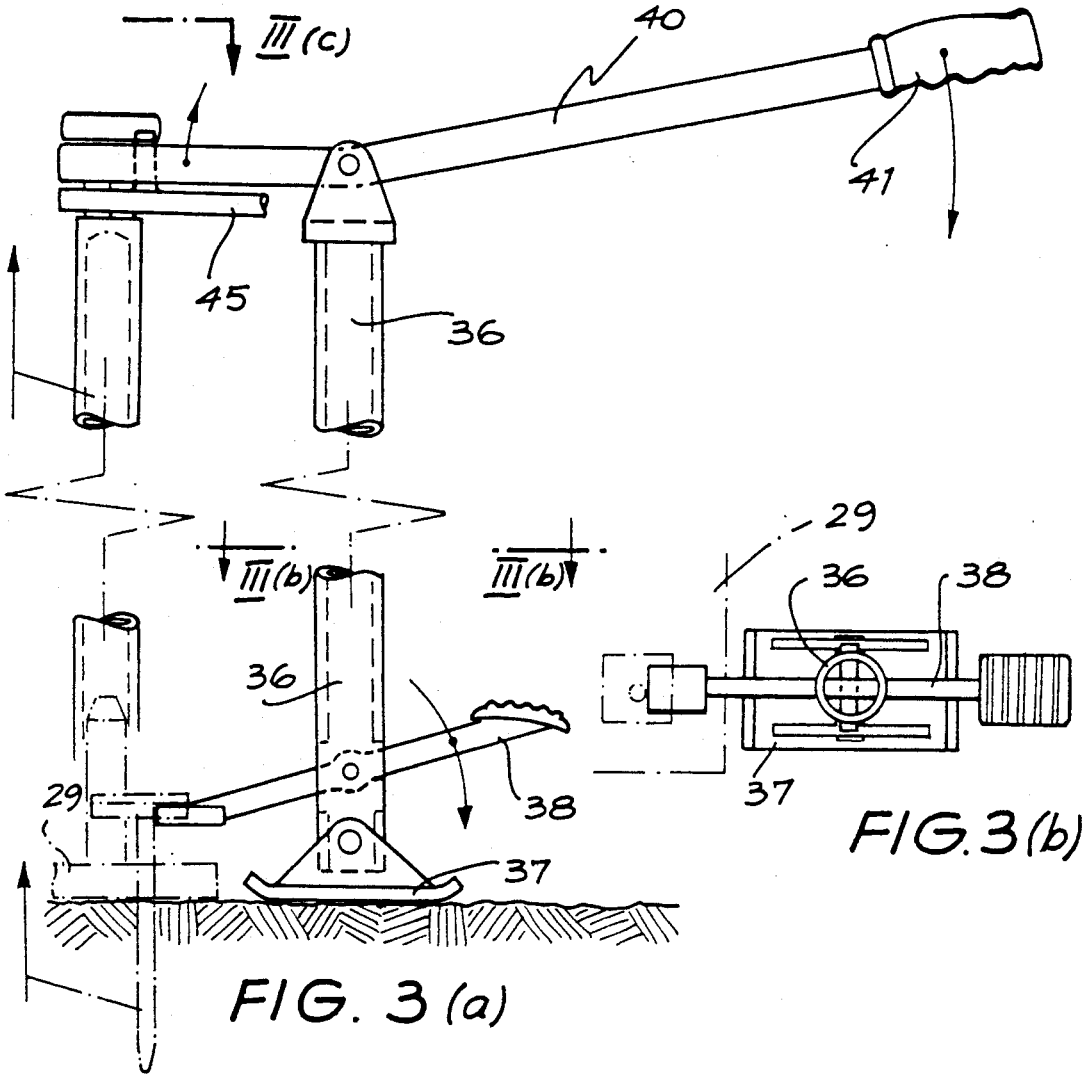
FIG. 3(b)
FIG. 3(a)
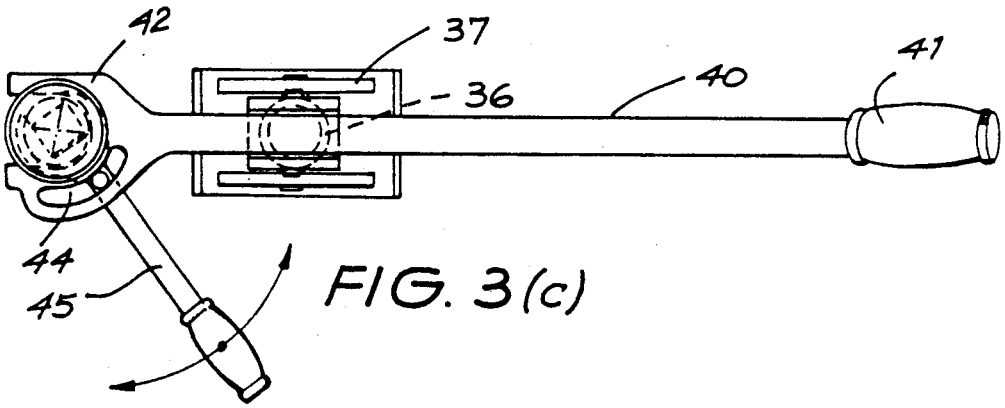
FIG. 3(c)

HANDLING AND SUPPORTING FLEXIBLE MATERIAL OF A FENCE

TECHNICAL FIELD

This invention relates to the handling and support of flexible material, and has particular application to the erection and handling of barricades or fences using such material. The invention is particularly applicable to barricades, and will be described herein in connection with that application.

BACKGROUND ART

Conventionally, barricades of flexible sheet material, such as brattice cloth or other open plastics fabric, is supported by so-called star posts driven in to the ground or roadway. Such posts are difficult to handle and to remove, and cause considerable damage upon removal, particularly where they have been driven in to asphalt or other roadway surfacing.

DISCLOSURE OF INVENTION

The present invention seeks to provide an approach to barricade construction which avoids these disadvantages. In particular, the invention provides a system of supporting and handling flexible material including a roll of flexible material, means attached to said flexible material for stiffening the flexible material, said stiffening means being placed at regular intervals along the length of said flexible material and means attached to said stiffening means for supporting the flexible material in use.

BRIEF DESCRIPTION OF DRAWINGS

FIGS. 3*a*, 3*b* and 3*c* show a tool for removing posts for use with the invention;

To facilitate description of the features of the invention, reference will now be made to the accompanying drawings, in which embodiments of the invention are illustrated, and many of its preferred features shown.

MODES FOR CARRYING OUT THE INVENTION

Figures 1, 2A, 2B:
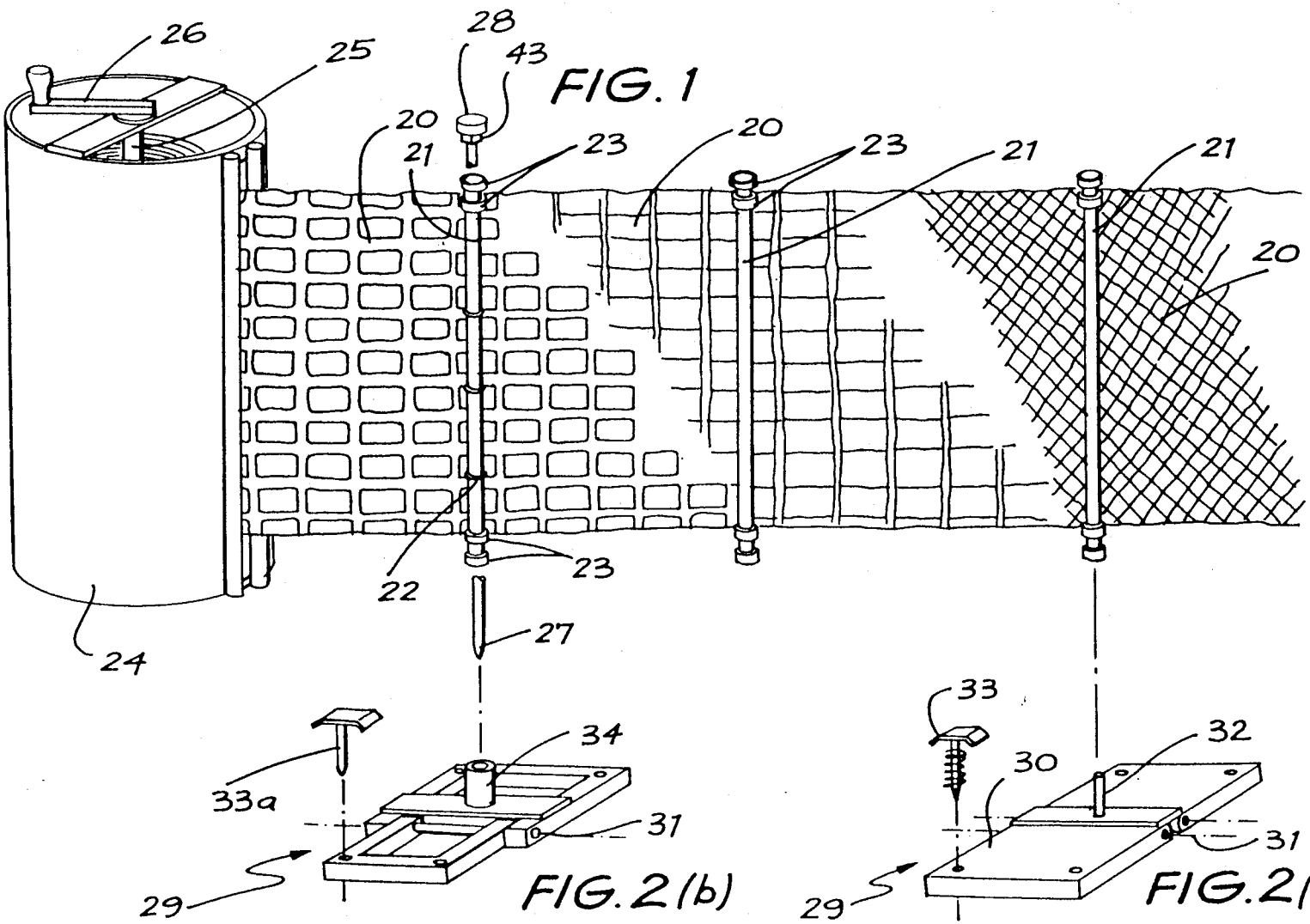
FIG. 1 shows an embodiment of the invention schematically illustrating its use for fencing.
FIGS. 2*a* and 2*b* show a base or stand for use with the invention.

FIG. 1 shows a length of barricading 20, in the form of open, non-woven mesh, of the kind well known for use in the erection of barricades. Fixed at intervals along the length of the material 20 are post-guiding tubes 21, of any suitable material, preferably of plastics material such as PVC, the length of each tube 21 being slightly greater than the width of the sheet 20. The tubes 21 may be attached to the sheet 20 by any suitable means, such as by ties 22.

At each end of each tube 21 there is fixed a pair of rings 23, which may also be of PVC.

In the embodiment illustrated in FIG. 1, the sheet 20 is housed as a roll within a cylindrical dispenser 24 provided with a central axle 25 and a winding handle 26.

For use with the equipment thus far described are posts 27, preferably of steel, these post being cylindrical and having a pointed bottom end and a head 28 at their upper end. The diameter of the posts 27 is such as to provide a clearance fit within the tubes 21, and the head 28 is dimensioned to abutt the uppermost of the rings 23 when the post is inserted into a tube 21.

The components thus far described may be used for the erection of barricading by placing the dispenser 24 at one end of the desired line of the barricade, drawing the sheet 20 from the dispenser to the desired length, inserting posts 27 into the successive tubes 21, and driving the posts 27 into the ground, the post being driven until the head 28 engages the top of the tube, driving the bottom of the tube against the ground. Where a significant length of barricade is to be erected, the procedure will normally be to fix the first post and then to move the dispenser 24 while paying out sheet 20.

Where the barricading is to be placed on a roadway or other prepared surface, and it is desired to avoid damage to that surface, stands 29 may be provided, as shown in FIGS. 2*a* and 2*b*. The stand 29 illustrated in FIG. 2*a* comprises a base 30 constructed in two halves hinged at 31 and provided with an upstanding rod 32, the diameter of which provides a clearance fit within the tube 21. At each corner of the base 30 there may be provided spring-loaded spikes 33, by which the stand 29 may temporarily be fixed to roadway, the small diameter of the spikes 33 avoiding significant damage to the roadway.

FIG. 2*b* shows an alternative construction of base 29, with an upstanding socket 34 replacing the rod 32, the socket 34 being of course dimensioned to receive the post 27, providing a clearance fit for the rings 23 at the bottom of the post 27. In this embodiment, the spikes 33 are shown as replaced by pegs 33*a*.

To facilitate removal of the barricading, the preferred form of the invention includes a combined spike-and post-remover, one embodiment of which is shown in FIGS. 3*a*, 3*b* and 3*c*. The post-remover 35 comprises a post 36, base 37, a foot-operated spike removing lever 38 provided at its free end with a spike-engaging portion 39 (see FIG. 3*b*), and having at its upper end a lever 40 comprising a handle 41 and a bifurcated end 42 (see FIG. 3*c*) dimensioned to engage the guide tube 21 between the upper rings 23. The posts 27 are preferably provided with a nut formation 43 (see FIG. 1). A spanner 45 may be mounted for limited pivoting action on the lever 40 by means of a slot 44.

It will be understood that the post remover 35 is employed by engaging the spike or peg engaging portion 39 (see FIG. 3*b*) under the head of the spike 33 or peg 33*a* and pressing down on the lever 38 with the foot. The bifurcated end 42 of the handle 40 is engaged with the upper end of the guide tube, and the handle 41 pressed down, accompanied if necessary by turning of the spanner 45 while this is engaged with the nut portion 43 to loosen the post. In such a way the removal of the barricading may proceed in an efficient and non-destructive way, compared with the prior art.

Figure 4:
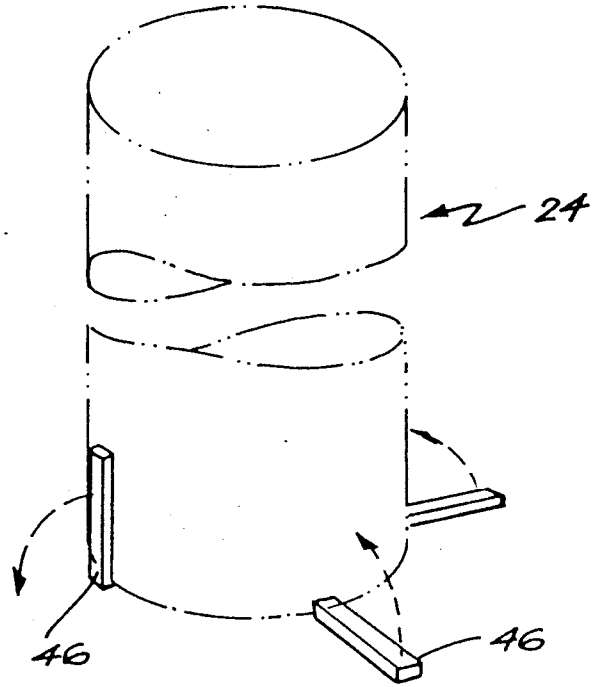
FIG. 4 shows a variation of the dispenser of FIG. 1.

The remaining figures show modifications or developments of the principles of the present invention. In FIG. 4 there is shown how the dispenser 24 may be provided with folding feet 46, while FIG. 5 shows a trolley 47 for the transport of the dispenser 24.

Figure 5:
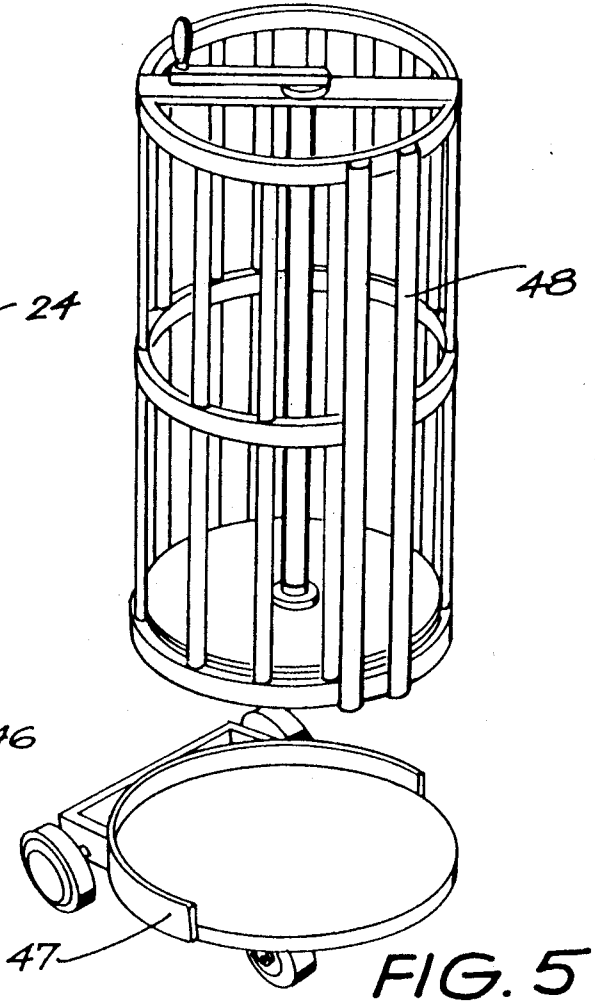
FIG. 5 shows a cart for use with the canister of FIG. 1.

In FIG. 5, a modified dispenser is shown, in which the cylindrical wall is formed by a number of tubes 48 for the reception of posts 27, so that these post may readily be carried along for use, as the barricade is erected.

Figure 6:
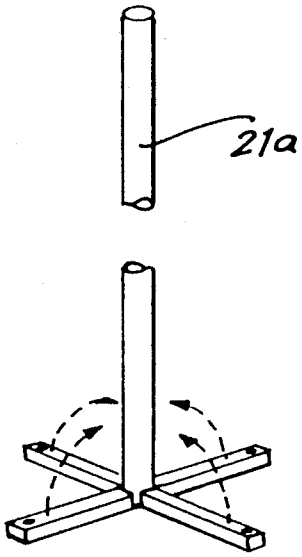
FIG. 6 shows an alternative form of support for the barricading of FIG. 1.

FIG. 6 shows an alternative approach to the support of the barricade, by means of tubes or posts 21*a* fixed to the sheet 20 and provided with folding feet 49.

Figure 7:
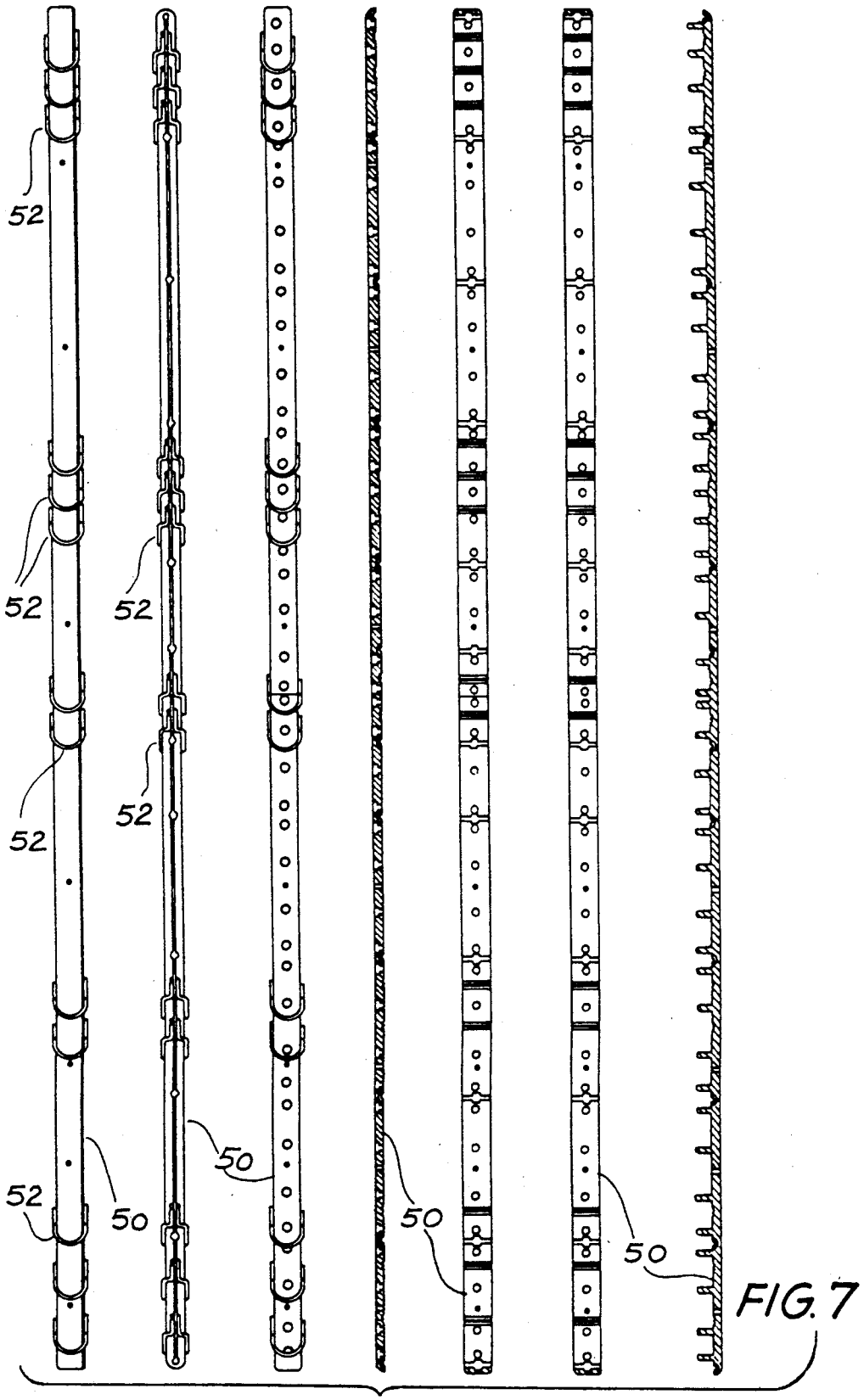
FIG. 7 shows embodiments of stiffening and supporting straps, for use with the invention.
Figure 8:
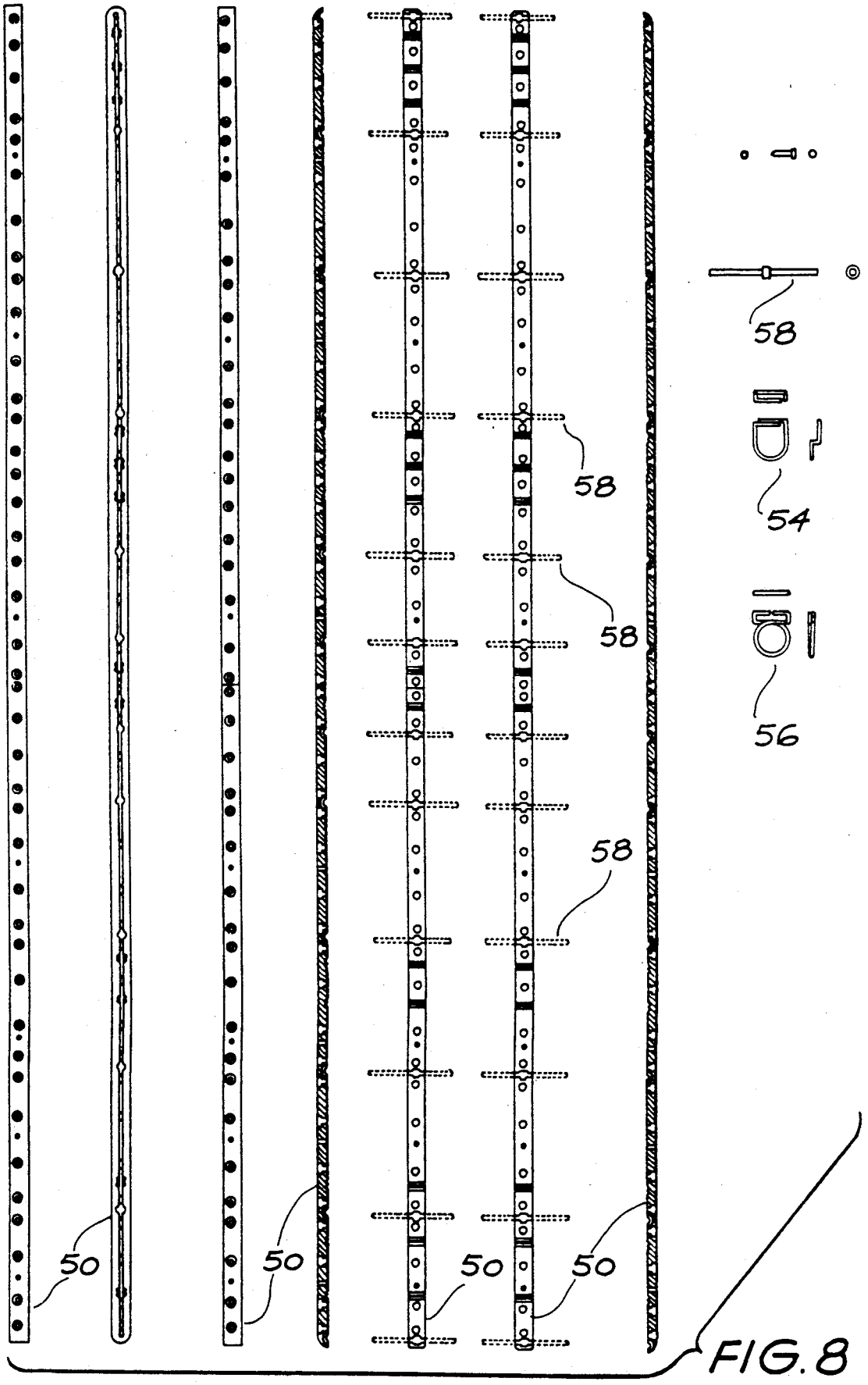
FIG. 8 shows further embodiments of stiffening and supporting straps.

Instead of post-guiding tubes 21 straps 50 such as shown in FIGS. 7 and 8 can be used to support the positioning of posts 27. These straps can also be used to stiffen the barricading 20 of FIG. 1. The straps 50 are provided with holes whereby dowels or pins secure the two halves of the strap together about the barricading. Spring clips 52 are fixed at regular intervals along the length of the strap 50 through which the posts can be inserted. The clips 52 can have a variety of shapes (54, 56). The straps 50 can also be used to provide stiffening for the barricading material, to secure other fixtures thereto such as signs or to allow attachment of other accessories as shown in FIGS. 17–20. The spring clips 52 are installed firmly against the strap 50 so that any accessory or attachment is held securely to the barricading due to the tendency of the spring clips to want to return to a normally vertical position. This aids also in the retention of posts 27.

The straps 50 also have provisions for carrying a variety of flexible wire, cords or rope at positions from the top to the bottom of the strap held in place by a ferrule 58. These wires can provide lateral stiffening for the barricading or support for signs attached thereto.

When simply used for reinforcing the barricading the straps 50 can be provided without provision for spring clips 52.

The stiffener straps 50 as shown in FIGS. 7 and 8 are made in one piece and are folded about the sheet of flexible material 20 to be secured thereto. Equally they could be made in two separate halves.

The straps 50 can be used to make temporary structures or permanent fixtures such as fencing. In the latter case screws, nails or other fittings would be used in place of the pins or dowels.

One advantage of the use of the straps 50 compared to the tubes 21 is that they occupy less space when the barricading is rolled up.

A modification of the invention shown with respect to FIGS. 1–6 and incorporating the stiffeners shown in FIGS. 7 and 8 will now be described.

Figure 9:
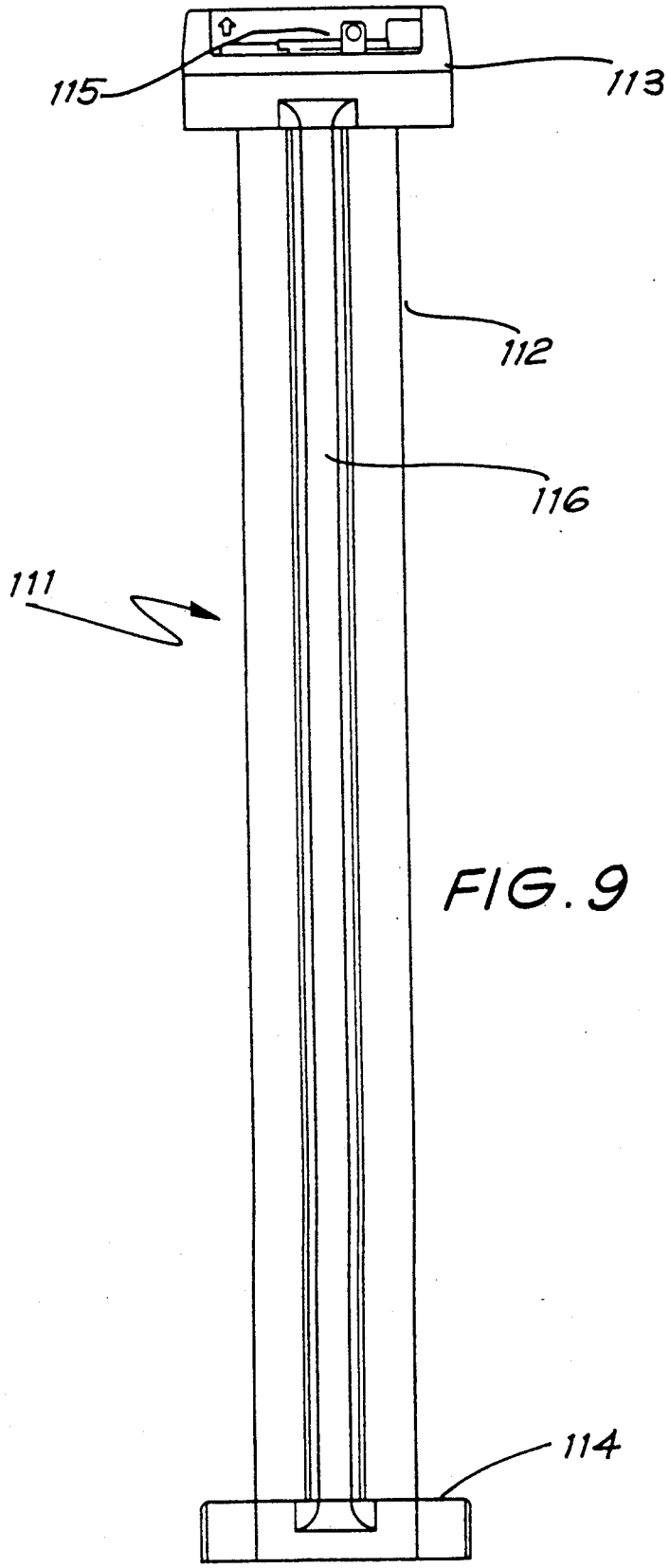
FIGS. 9–20 show another embodiment of the invention.

FIGS. 9–20 show another embodiment of the various elements making up the system of holding and supporting flexible material which constitutes the present invention. FIG. 9 shows a dispenser 111 which dispenses and retrieves the flexible material so that it can be stored on a temporary or permanent basis. The dispenser 111 involves a casing 112 having a top 113 and a base 114 and incorporating a locking assembly 115 which allows the dispenser to be set in a locked or free position so that the flexible material can be unwound or rewound therefrom via opening 116 in the casing 112.

The flexible material is wound upon a dispenser axle, the axle is designed to be complimentary to that of the dispenser allowing easy access to remove and replace the axle with the attached material within the dispenser in a matter of seconds. The combination of the axle and the flexible material constitutes a cartridge which can be loaded or inserted into the dispenser for dispensing. Thus dispensers can have a range of cartridges with preferred lengths and materials that can be quickly identified and used. The dispenser axle is designed to be of a standard size so that it can fit all dispensers.

Figure 10:
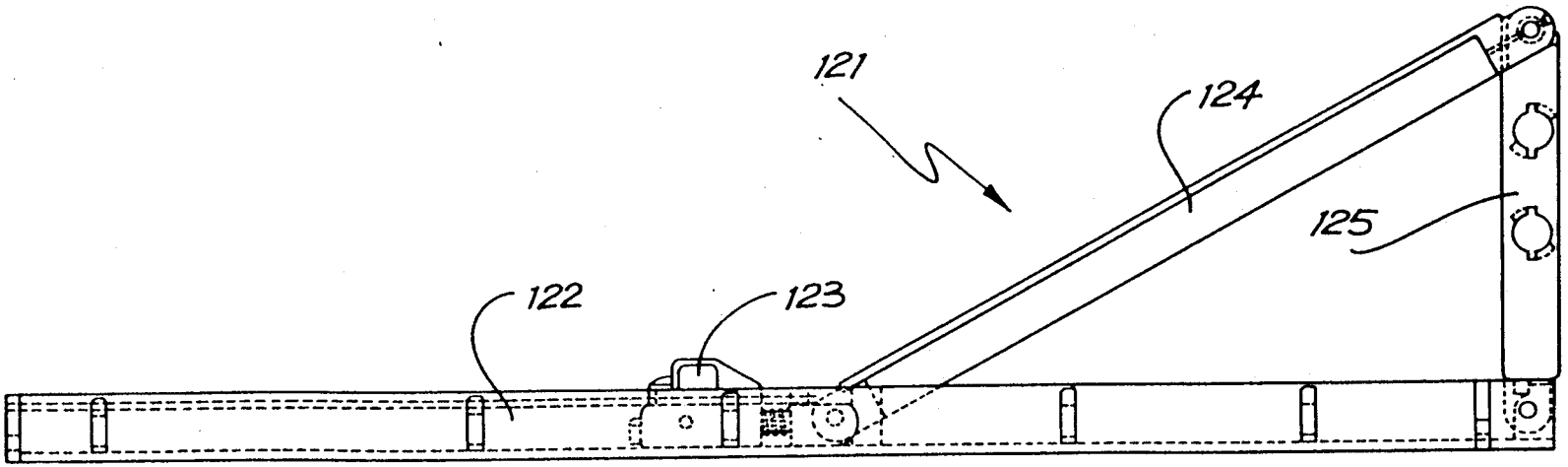

The dispenser 111 can have its own stand as shown in FIG. 10 to provide stability while material is being dispensed or retrieved. The stand 121 is accommodated in a stand case 122 which consists of a control mechanism 123 called a slide lock that is connected to the stand brace 124 which in turn is connected to the base leg 125. The stand is lowered and locked in place by the slide lock mechanism 123. The stand case 122 has provisions by means of a designed adaptor to enable the stand to be attached to support the stiffeners for added stability and support for temporary erected systems. When the stand 121 is retracted the base leg 125 and the brace 124 are contained and locked within the stand case 122.

Figure 11:
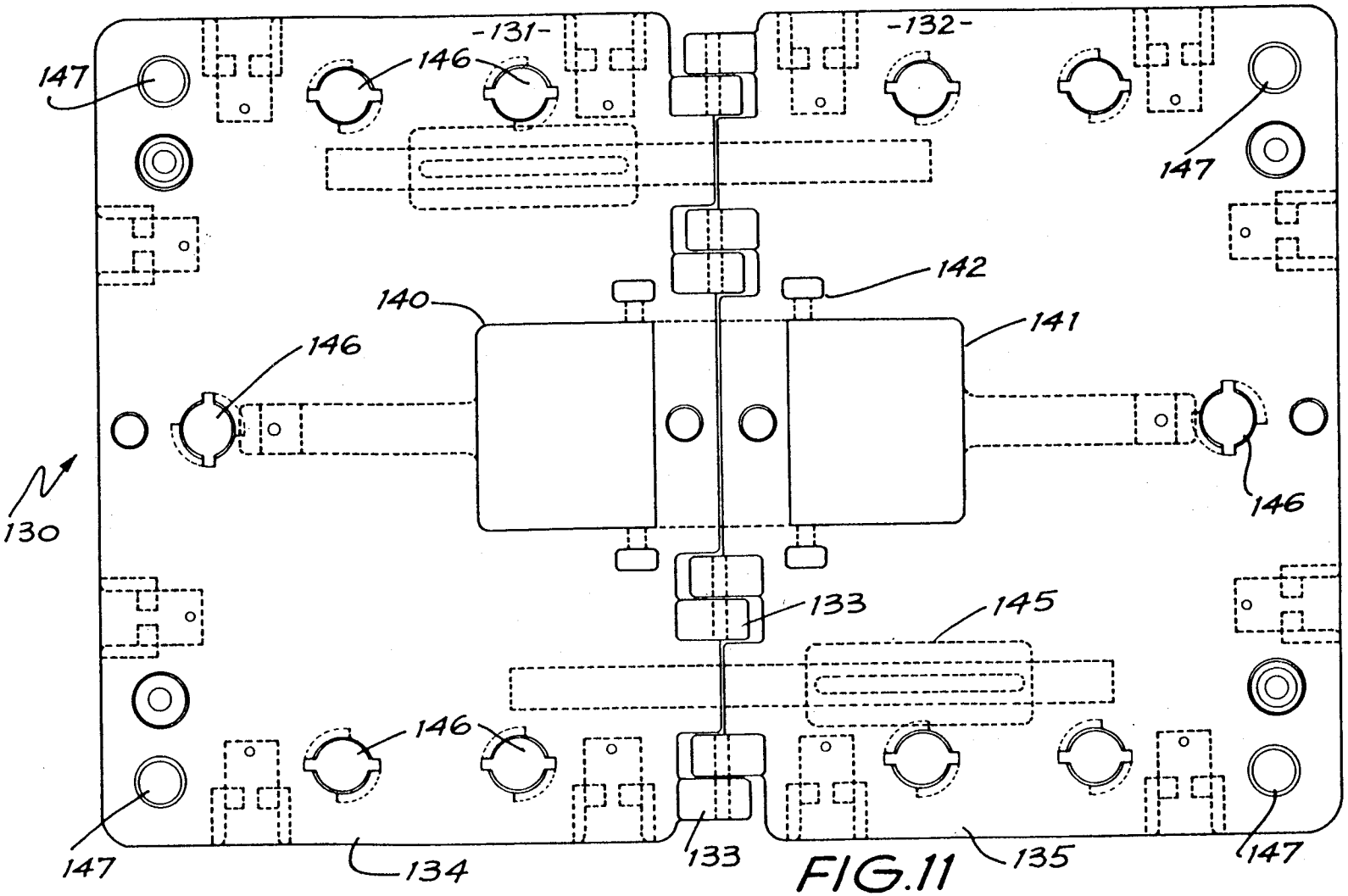
Figure 12:
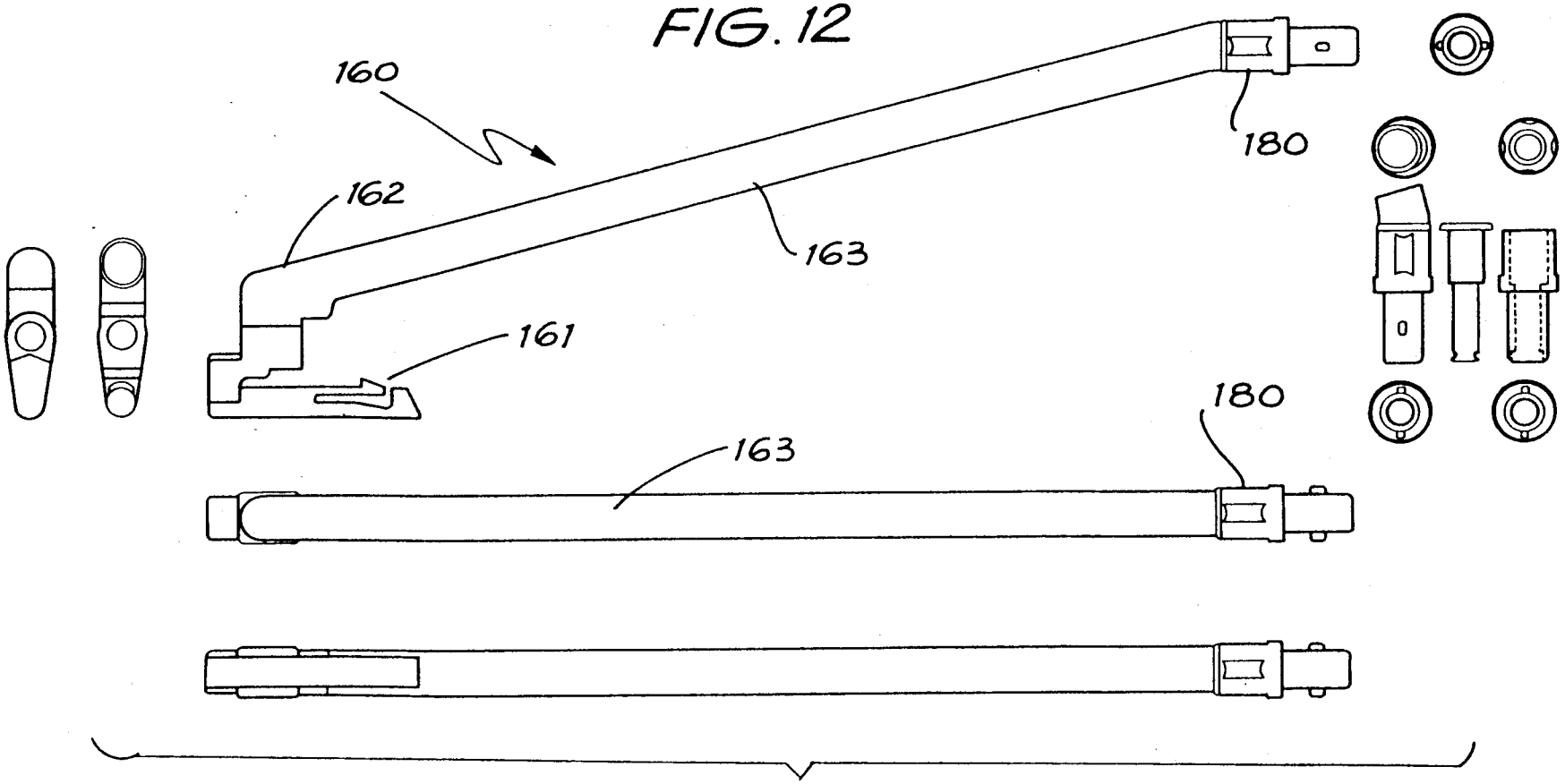

As shown in FIG. 11 a freestanding support system utilising posts utilises a stand 130 consisting of two identical halves 131 and 132 joined in the centre by way of hinges 133. The hinges 133 allow the stand to fold together such that the two top halves 134 and 135 of each side become enclosed within the centre protecting the stand halves. Two locks are provided to hold the folded stand together for storage. The stand allows for the post stiffener that is described with respect to FIGS. 7 and 8 to be supported and braced in the centre or at a side of the stand or at several such locations if required. The stand can also be used in a folded position to allow the required product to be installed or erected in confined locations. Depending on the surface upon which this stand is erected various accessories and attachments are provided. Each half 131 and 132 of the stand has a small folding stand 140 and 141 enclosed at the top thereof that can be lifted up to provide a further support system. These mini stands 140 and 141 can be located to support the post stiffeners via clips carried by the stiffeners. When both mini stands 140 and 141 are raised the post stiffeners will be supported so that the clips on both sides of the stands can be used to locate the post stiffeners in a vertical position without the risk of overbalancing. The mini stands 140 and 141 have provision for a tension spring that can be located on the mini stand hinge pin 142. When this spring is engaged the mini stand will be held in a vertical position allowing the post stiffeners to be supported upright by the mini stand. This feature also allows the post stiffeners to be collapsed or folded down to the horizontal position against the spring tension in one direction only and to return to the vertical position when the spring tension is released.

The stand halves 131 and 132 are held and locked to form a flat base by way of slide locks 145 on both sides, located in the top of the stand. The stand is provided with adaptor sockets 146 that can be located at suitable positions at the sides, top and bottom of the stand to accommodate a range of accessories and attachments to be described below. The stand 130 can be secured to a surface to eliminate movement by means of holes 147 at the back and sides of the stand base by means of spikes or pins when the surface is bitumen or hard earth or with nails or bolts when the surface is timber.

The system of stand and post stiffener can be further enhanced by the use of a stand brace as shown in FIG.

12. These braces can be used to provide single or double bracing such that the additional support provided by the brace or the braces allows the installation of other accessories in the installed or erected system. The brace can also be supported by other means away from the stand to allow for the horizontal support of materials using the post or material stiffener straps. The brace 160 is held in place by the locking pin 161. The lock pin 161 is designed into the top of the brace to allow the lock pin 161 to pass within the clips on the post stiffener straps without obstruction, the lock pin 161 is further supported to the brace 160 at the top 162 in a raised section that joins the lock pin to the top of the brace. In between this raised section supporting the lock pin 161 and the brace arm 163 there is provision to accommodate a further lock pin for a second brace to be installed.

Figure 13:
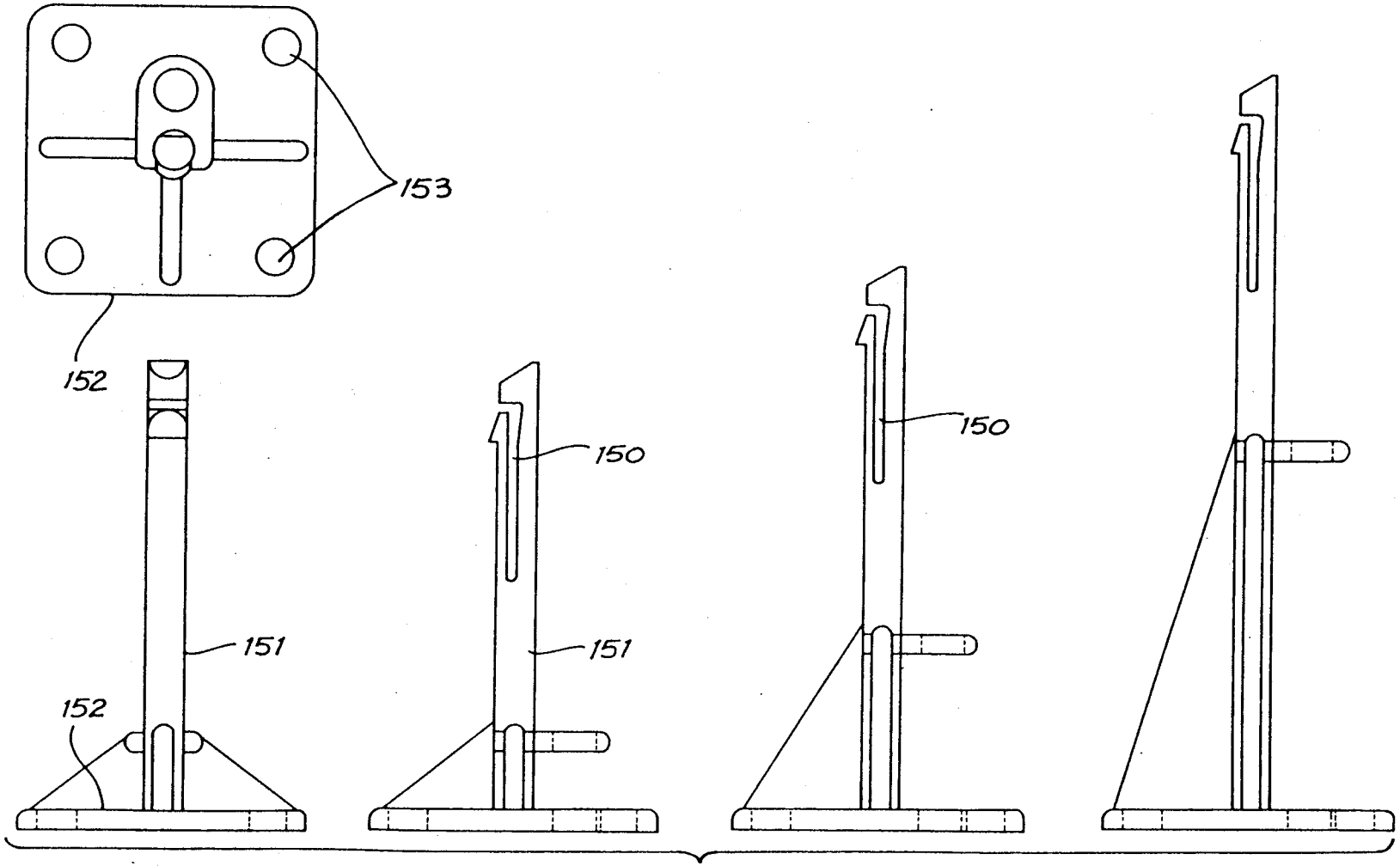

A further form of stand can be provided as shown in FIG. 13. The function of this stand is to support the erected system at a required height above the ground. A lock device 150 is made to secure the stand post 151 to the clips at the base of a post stiffener. The stand is also provided with a base plate 152 to support the system on soft surfaces via holes 153. A range of these stands can be provided to cater for various heights or setting desired while allowing the use of drive in or screw type post fitted through holes 154 to secure the erected product thereto if required.

Figure 14:
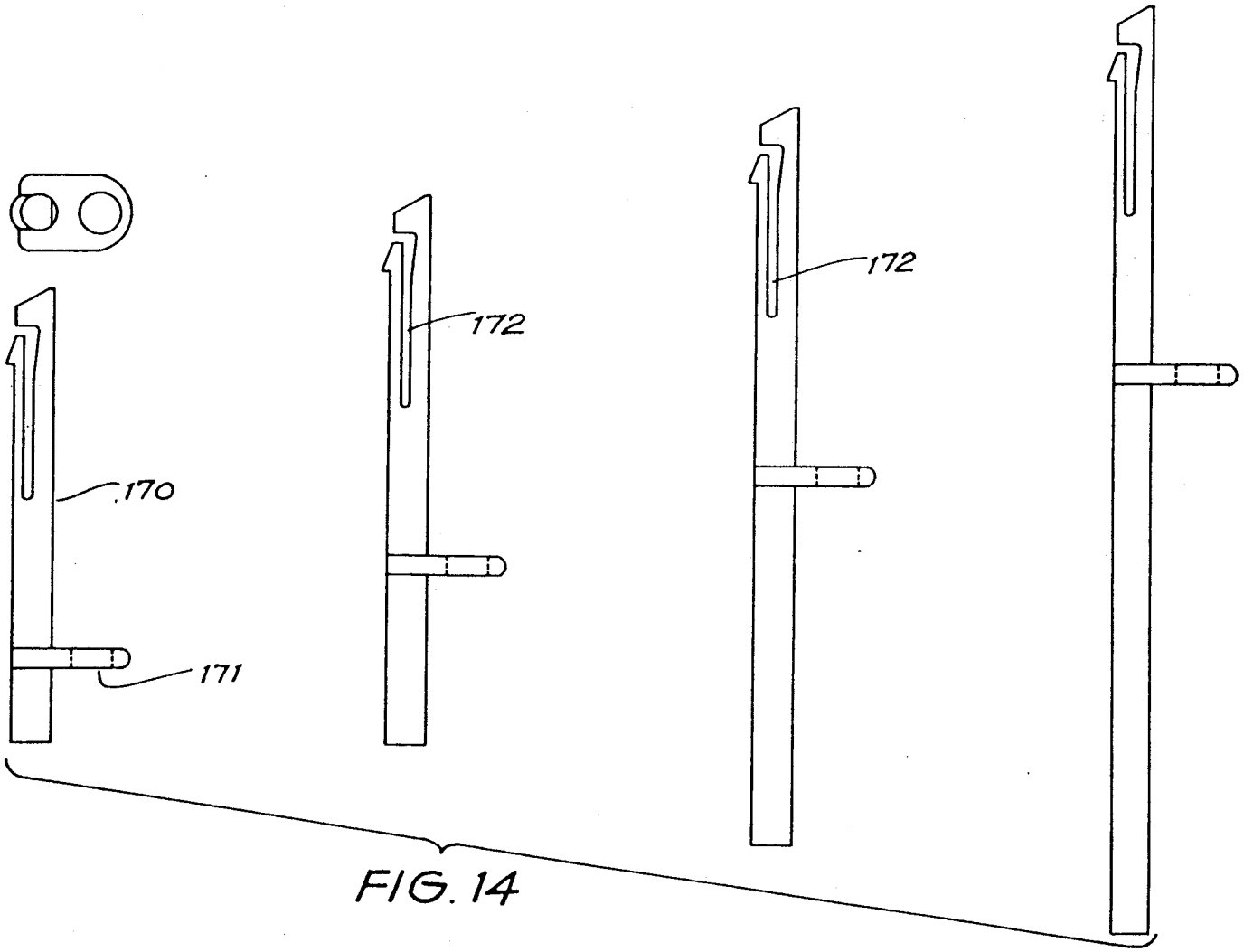

A further type of stand is the element shown in FIG. 14 which is called a ground spacer. The ground spacer allows for a range of support enabling the erected product or system to be elevated and supported at selected distances above the ground. Unlike the mini stands the ground spaces are not provided with a base plate. The ground spacer has an arm 170 provided with a hole 171 through which a post can be located or fixed. The arm 170 which can be of various lengths carries a locking device 172 to engage the clips of a stiffener strap.

Figure 15:
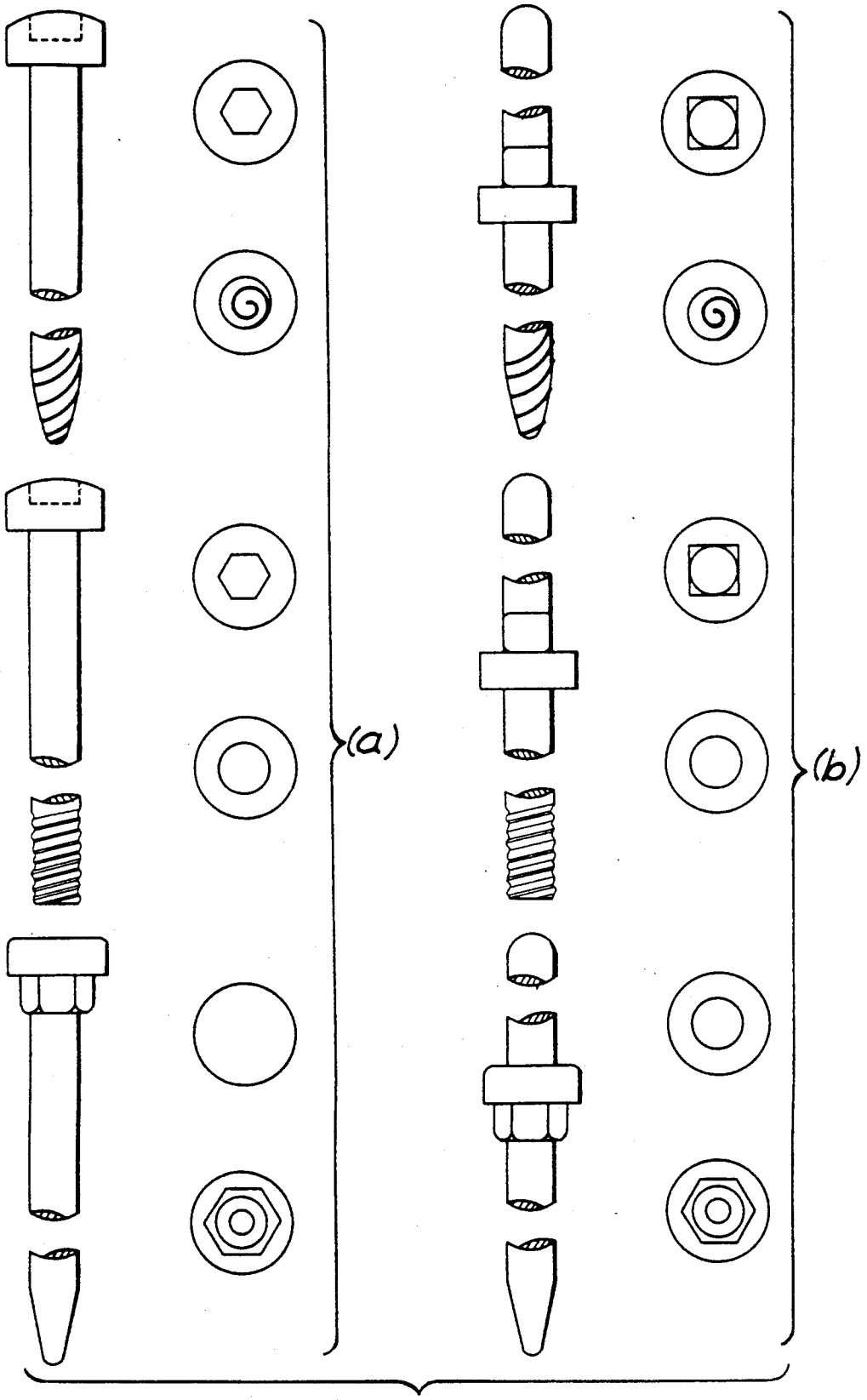
Figure 15:
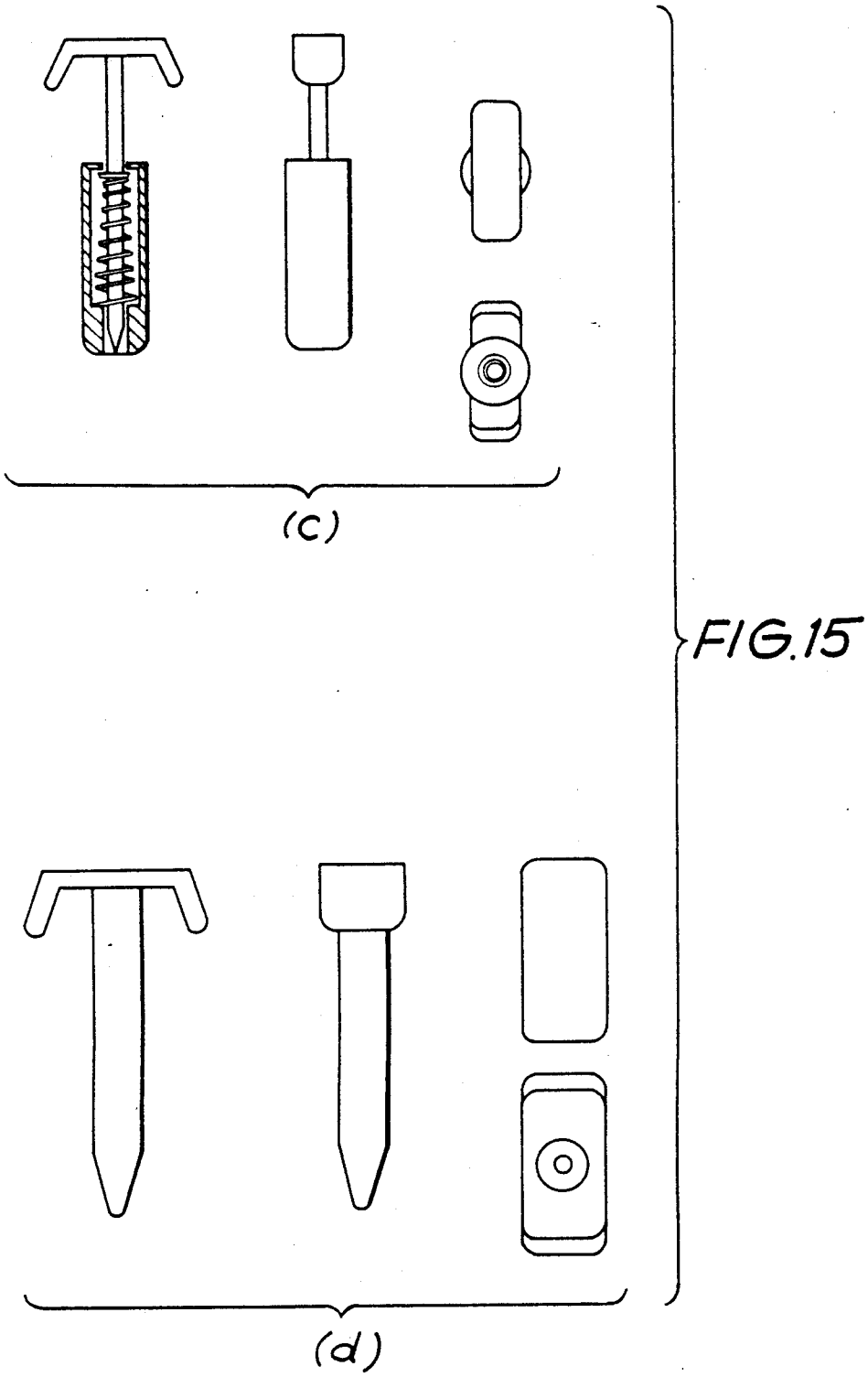

Various types of posts and fixing means are shown in FIG. 15. The posts can have a variety of bottom ends such as a plain, threaded or screw type as shown in FIG. 15(*a*). The posts can be made in any suitable size and can be provided with adaptors to allow extension of the height of a given post as shown in FIG. 15(*b*).

Various forms of spikes and peg are illustrated in FIG. 15 (*c*) and (*d*) respectively. The spike is designed to retract within the spike case if accidentally removed or dislodged thereby keeping the point of the spike within the case eliminating dangerous projections.

Figure 16:
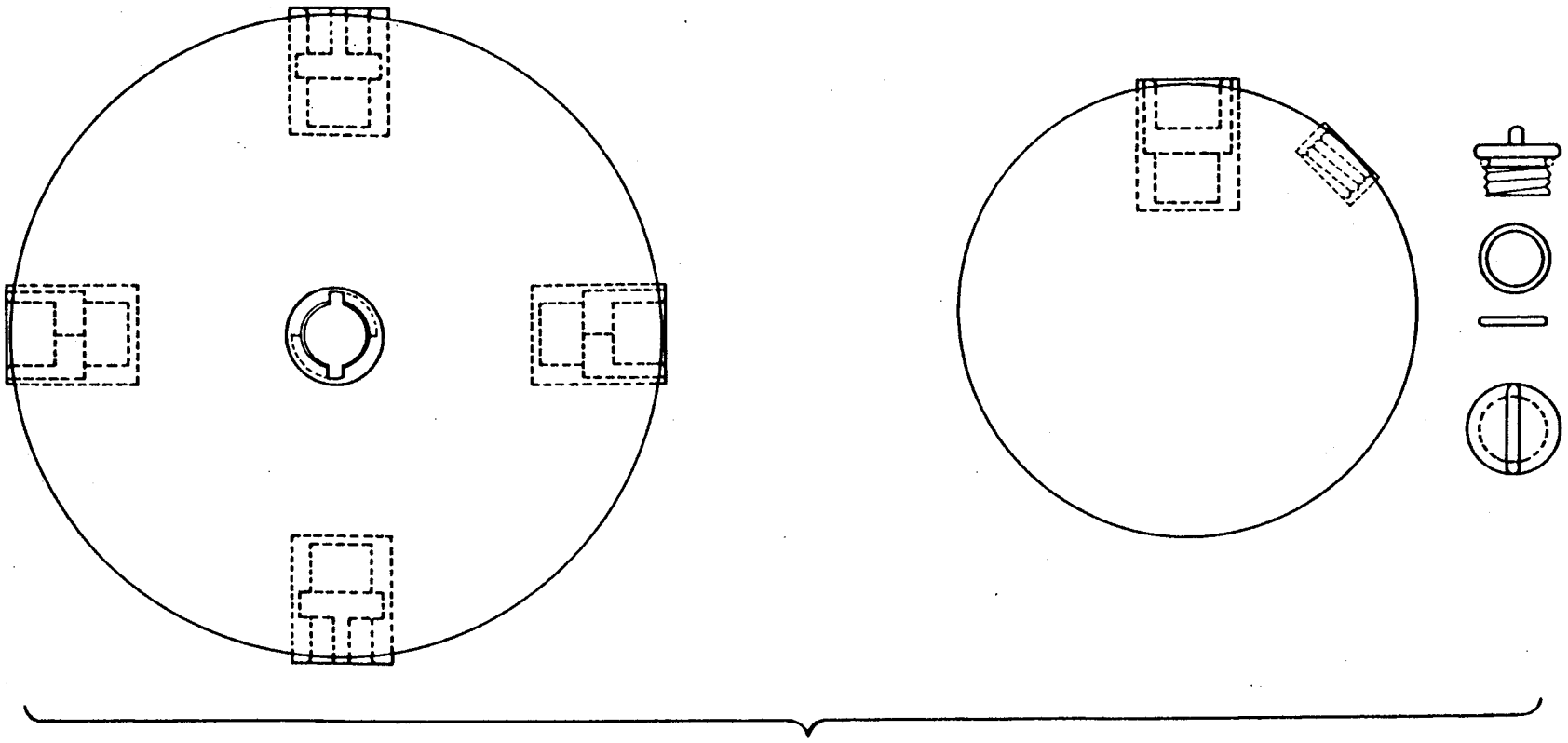
Figure 17:
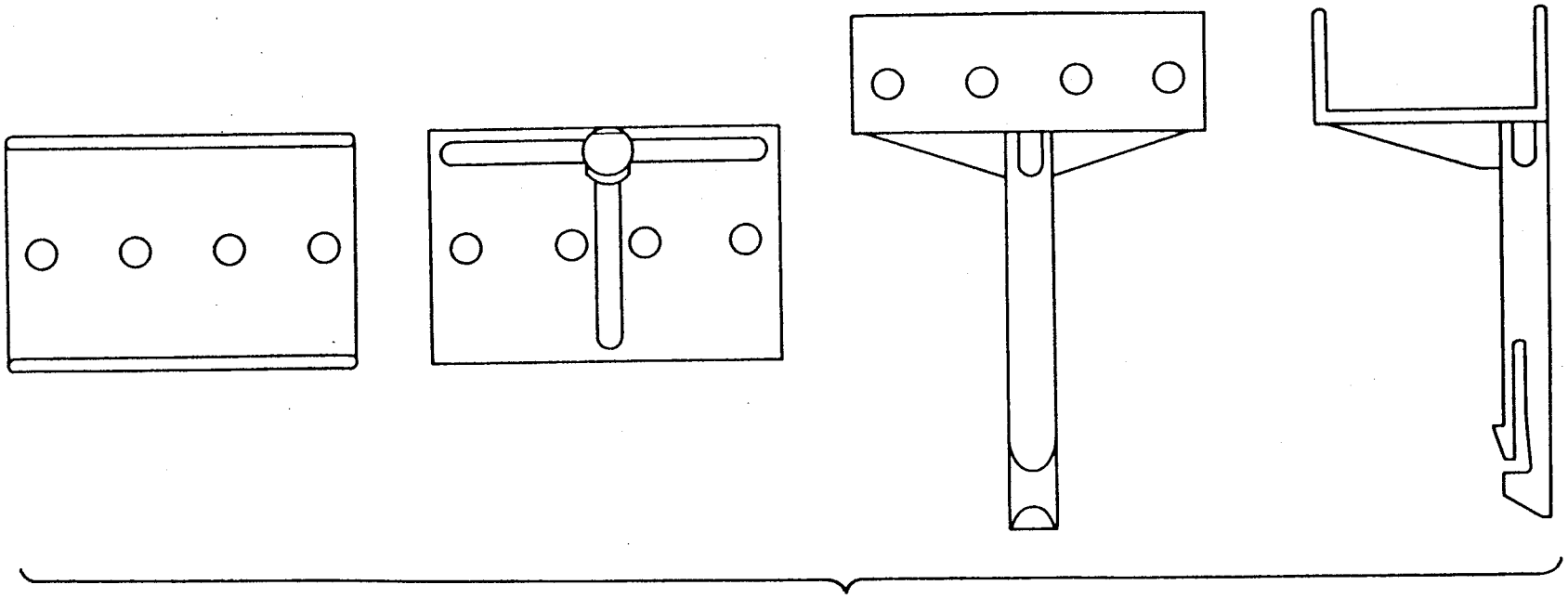

The spikes and pegs can be used to secure the various forms of stand to associated surfaces. To support the erection of the system on water a float as shown in FIG. 16 is provided. The design of the float provides for many combinations of flexible type products to be installed above and below the water surface. Accessories such as the carrier for cable, hose and pipe as shown in FIG. 17, can be provided to keep the installation well above the water line.

Figure 17A:
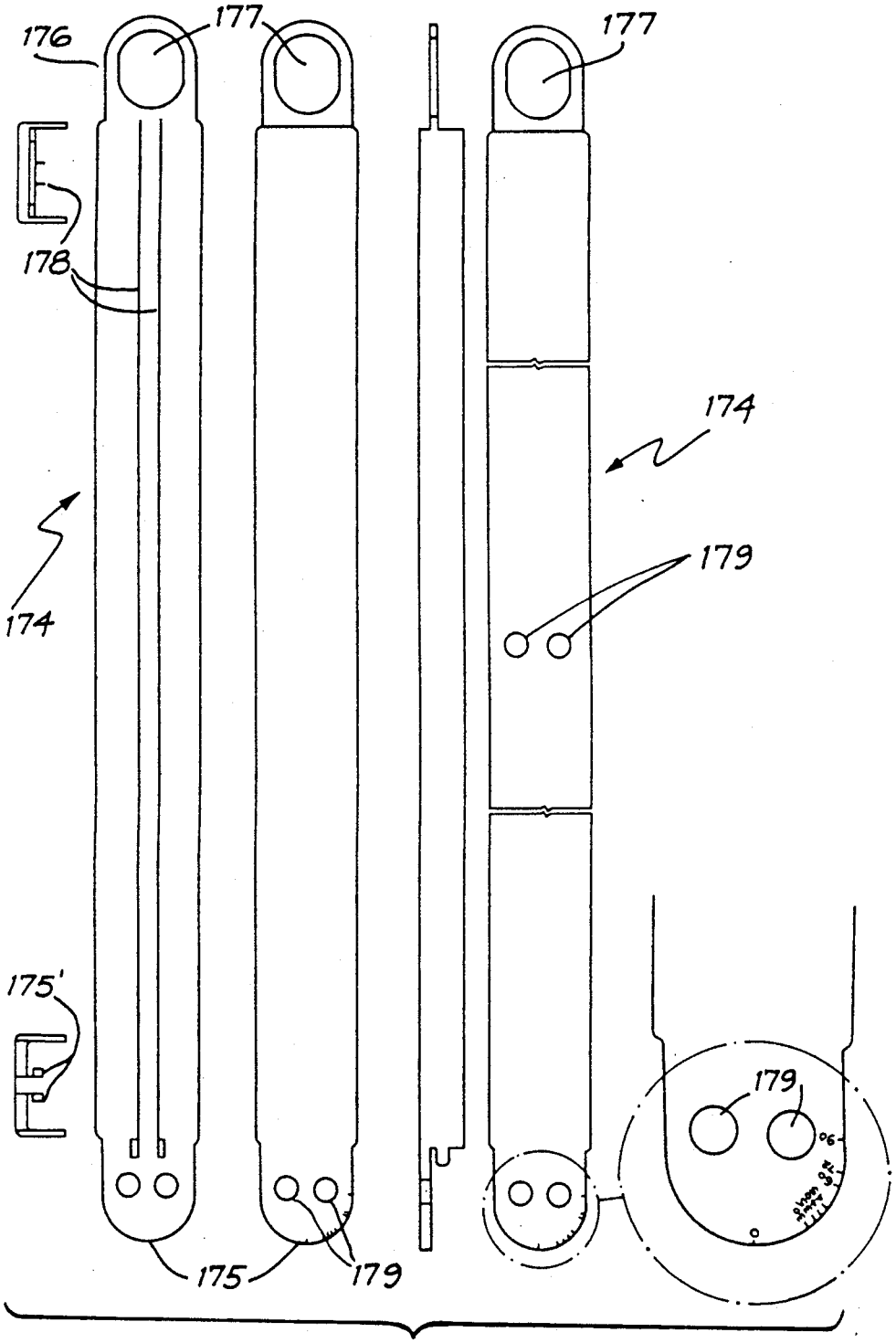

A hand rail as shown in FIG. 17A is provided to act as a protection for the public in areas of high usage as well as providing a means whereby installations of particular patterns can be quickly erected. The rail caters for vertical loading occasioned by leaning or other contact with the installation. With reference to FIG. 17A the hand rail 174 is an inverted channel section with one end 175 cam shaped and the other end 176 stepped down and rounded off having an elongated centre 177. Centred within the channel on the underside of the hand rail 174 and running the length of the hand rail 174 is a secondary channel formed by projections 178 which at the cam end 175 are formed into a pair of lugs 175'. These lugs 175' accommodate the end 176 (with the elongated centre 177) of an adjoining hand rail. The channel formed by projections 178 accommodates the top of the flexible material 20 forming the fencing, or barricading including any guide wire, cord or rope used in the erection thereof The cam end 175 is provided with holes 179 to accommodate posts 27 and is marked in convenient degree settings to enable polygonal enclosures to be constructed with ease when adjacent rails are joined at these angles, e.g. 45° allows an Octogan and 60° a Hexagon to be formed. The hand rail keeps the flexible material 20 taut while the desired setting is made (up to 90° in either direction) and the posts 27 secured.

Figure 17B:
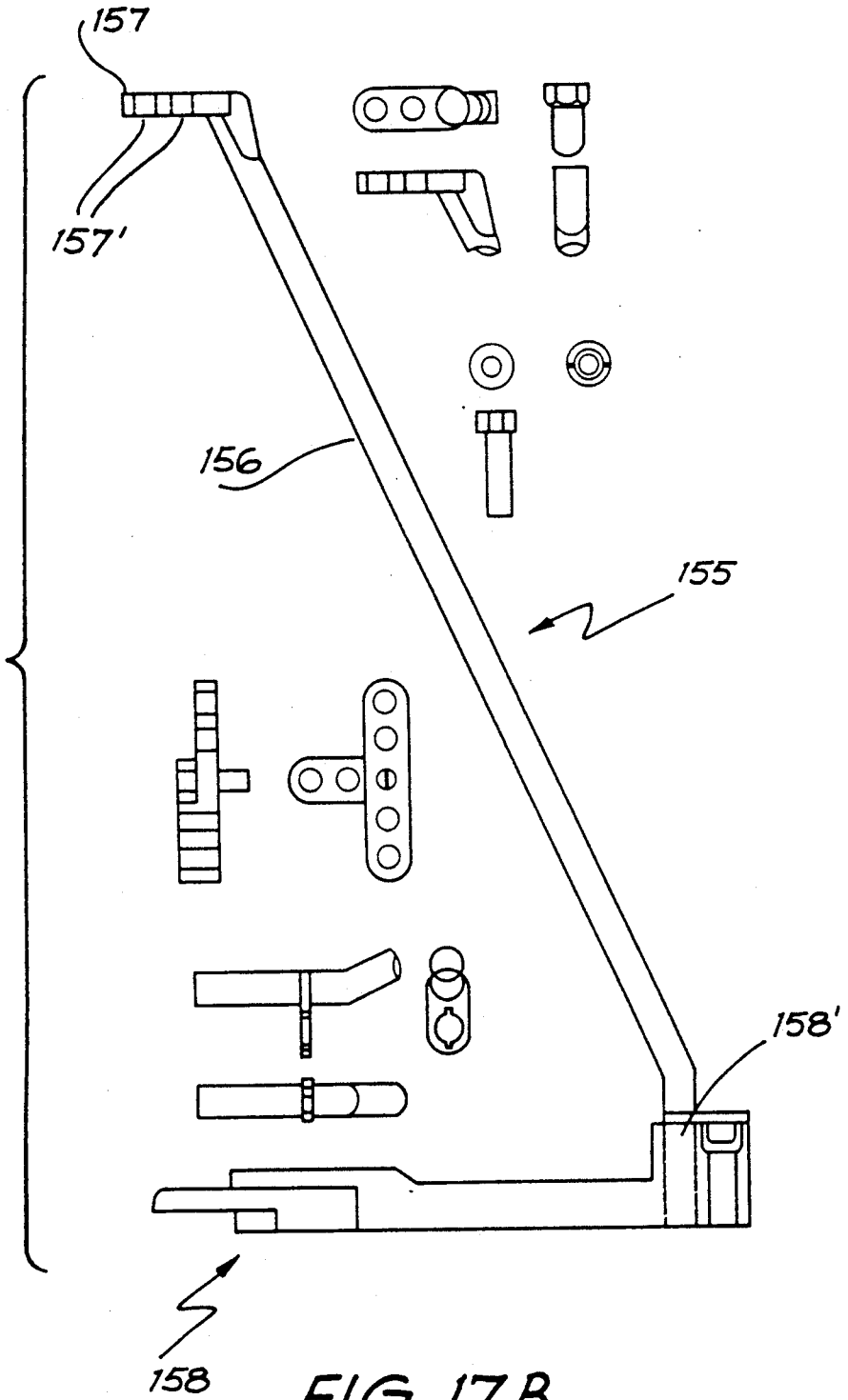
Figure 17C:
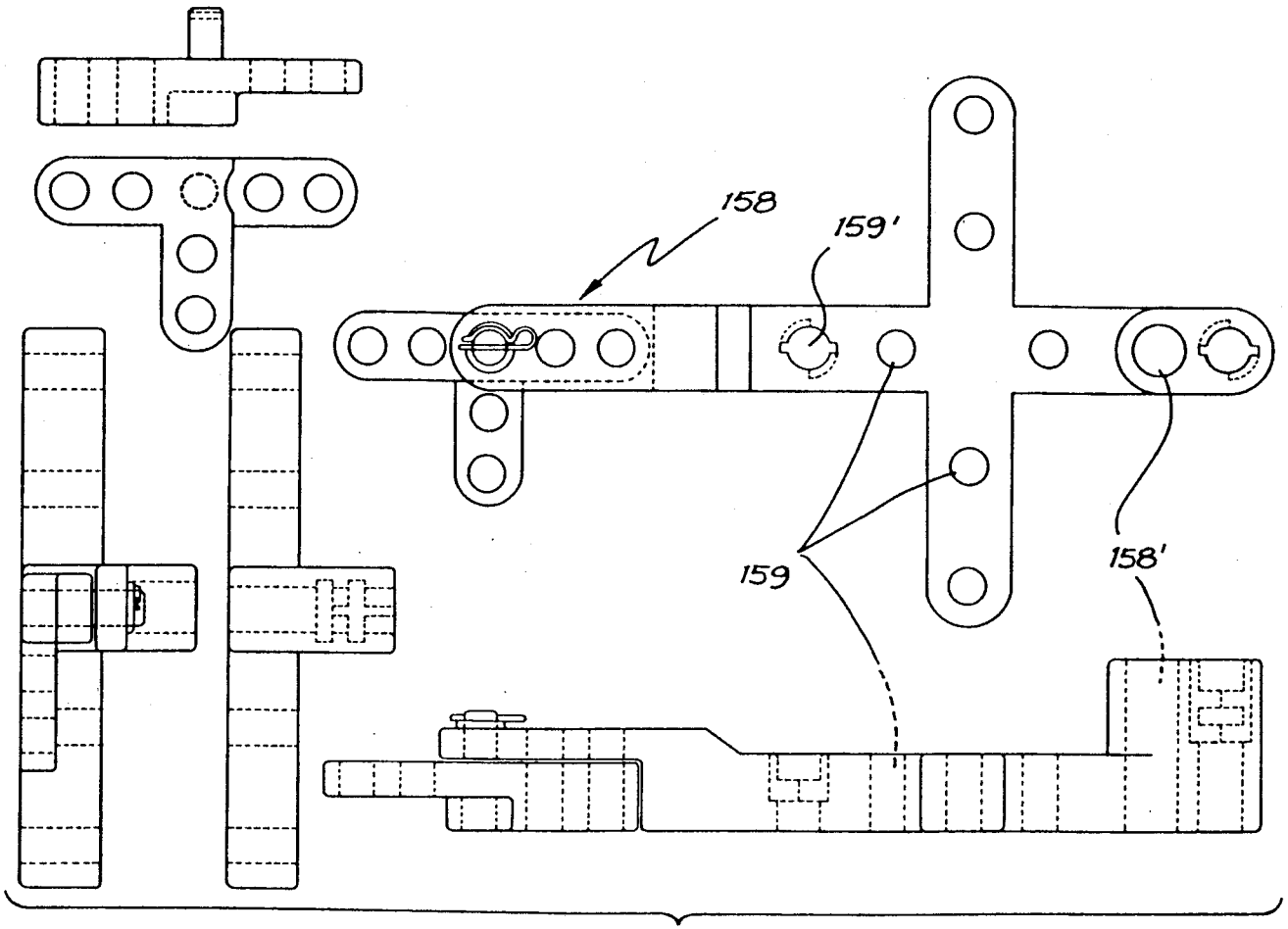

A variation of the brace 160 and stand 130 is the "agricultural brace" comprising the brace 155 and the support base 158 shown in FIGS. 17B and 17C. These items (155 and 158) are designed for situations where a heavy duty support is required to withstand and absorb high loadings. The brace 155 comprises a brace arm 156 with a top support plate 157 having holes 157'. The holes 157' are to accommodate posts 27 on either or both sides of a stiffener strap 50. The other end (to said top plate 157) of the brace 155 is accommodated in hole 158' in the support base 158. The support base 158 has a cruciform shape and is provided with holes 159 to secure the base 158 by pegs or spikes (see FIGS. 15(*c*) or (*d*)) to a supporting surface. Sockets 159' are also provided to allow accessories to be fitted to the base 158, for example to provide lateral bracing.

Figure 18:
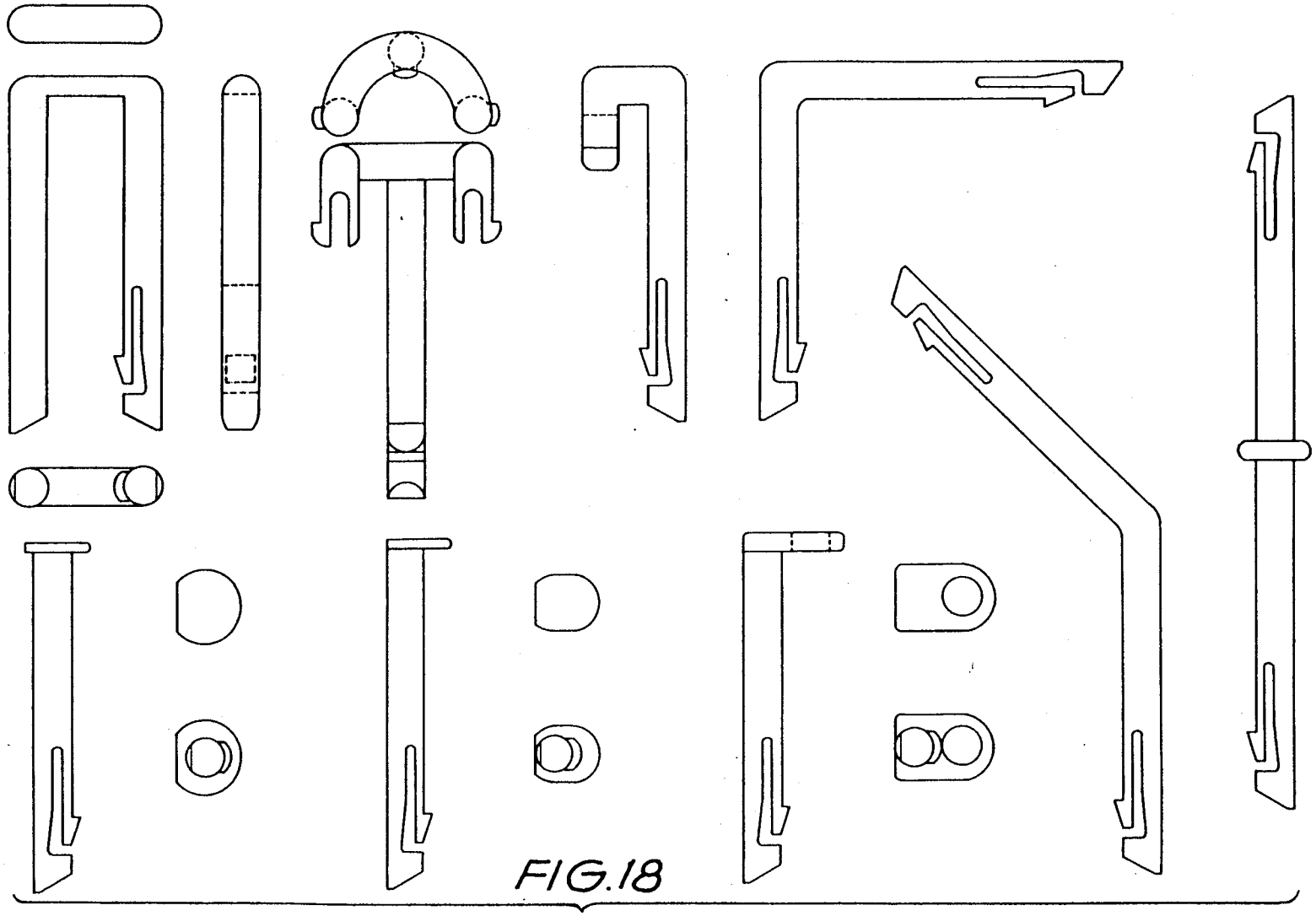
Figure 19:
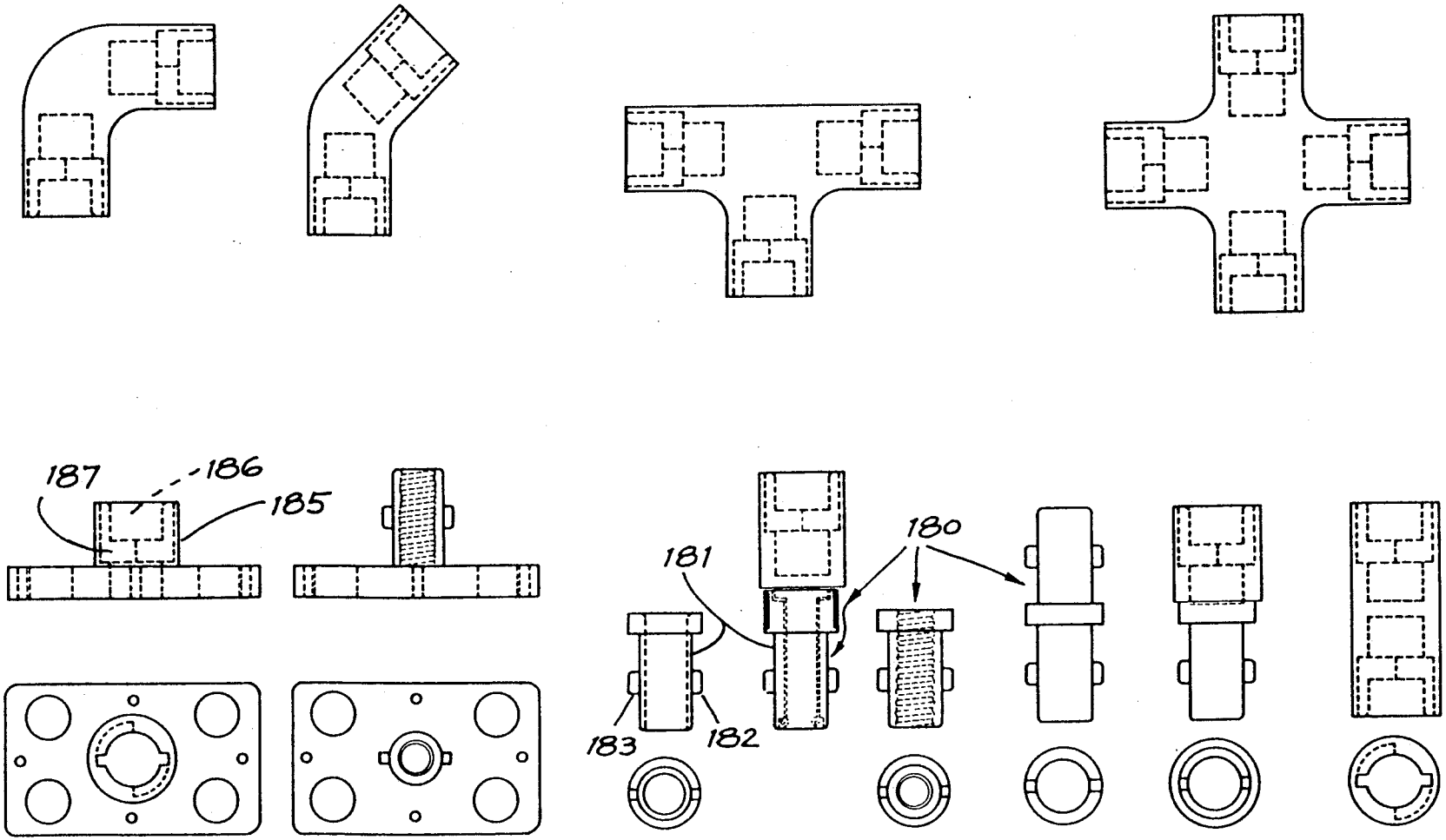

Various forms of adaptors can also be provided to enhance the utility of the present system. Among these are the fence adaptor pins as shown in FIG. 18 and the lock adaptors shown in FIG. 19. The fence adaptor pins are designed to hold and secure many of the accessories within the clips of the post stiffener straps and allow for joining one post stiffener strap to another. The adaptor pins can be provided with a 90° bend, a 45° bend, be of "U" shape or can be configured to allow double usage as shown in FIG. 18.

Figure 20:
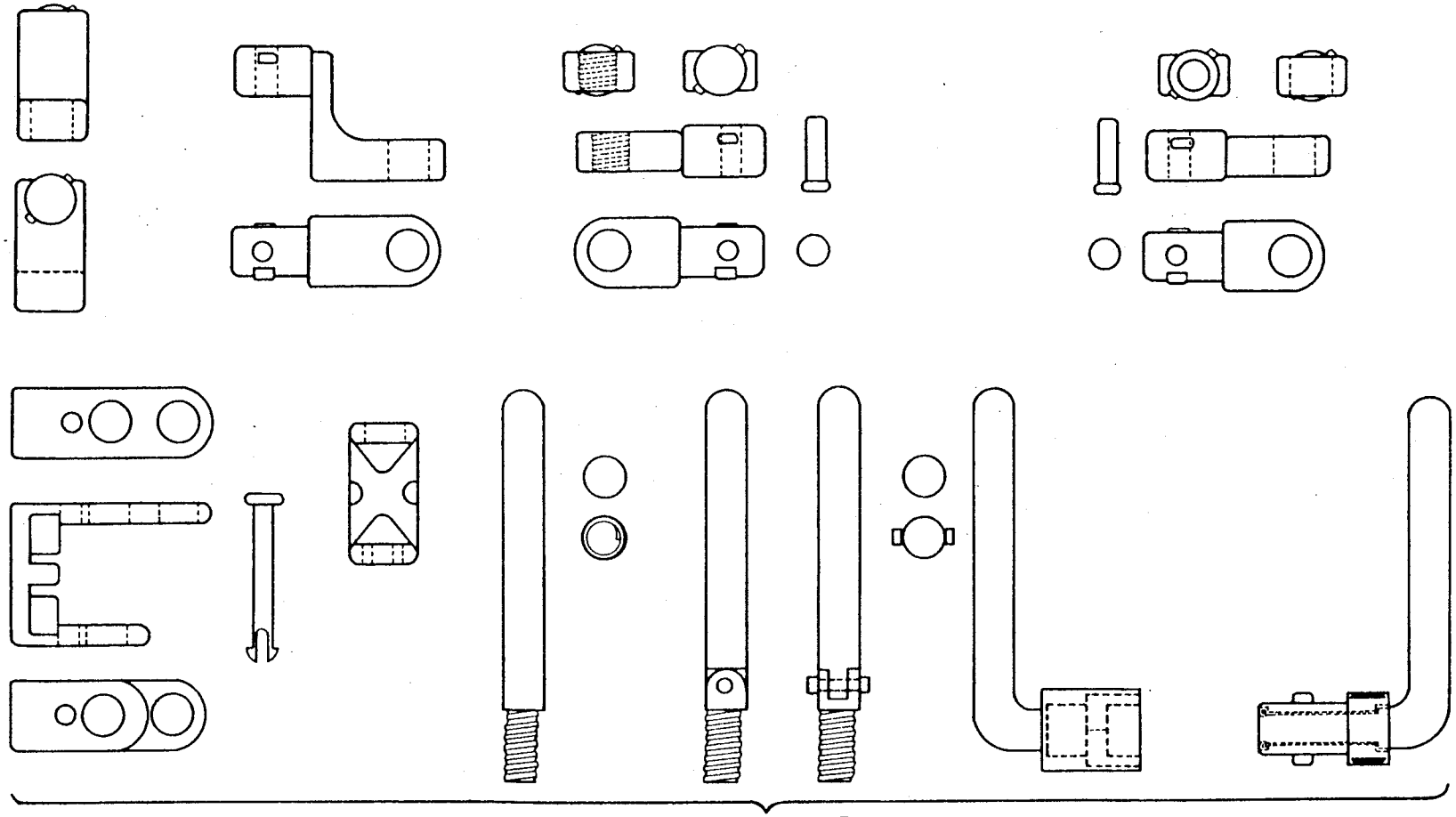

The lock adaptor is an element that allows in combination with the adaptors of FIG. 20 components of the system to be secured together. The adaptors can have a male or a female design, with a male adaptor 180 having a shaft 181 with two keys 182 and 183 located midway on the shaft 181 and a female adaptor 185 being a socket 186 with keyways 187 positioned within the socket 186 to accommodate the keys 182 and 183. The socket keyways 187, are extended at 90° from the base of the keyways to allow the male adaptor 180 to turn and lock within the socket 186. They can be made in plain, stepped or threaded forms.

Figure 21:
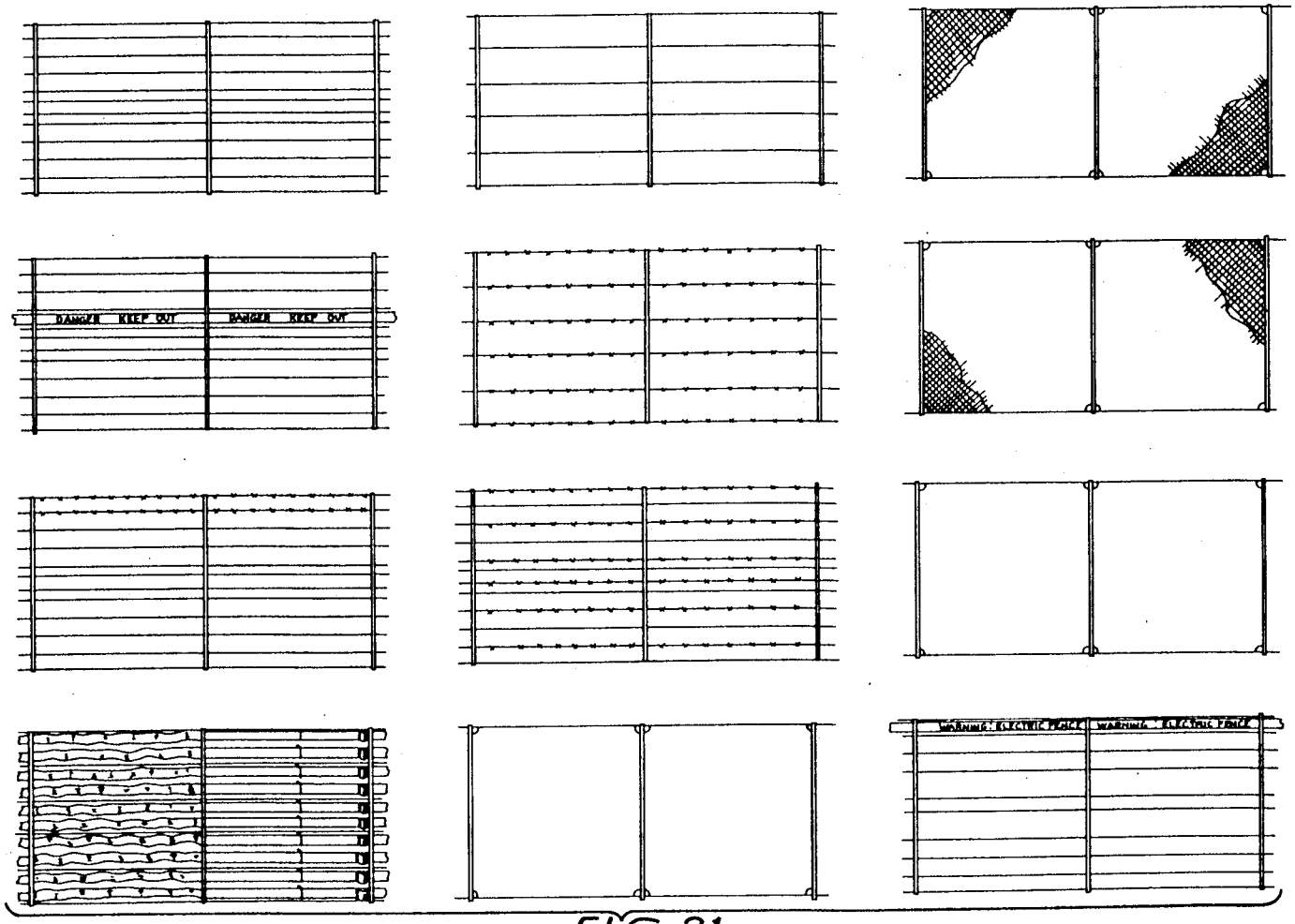
FIGS. 21–24 show various uses of the invention.
Figure 22:
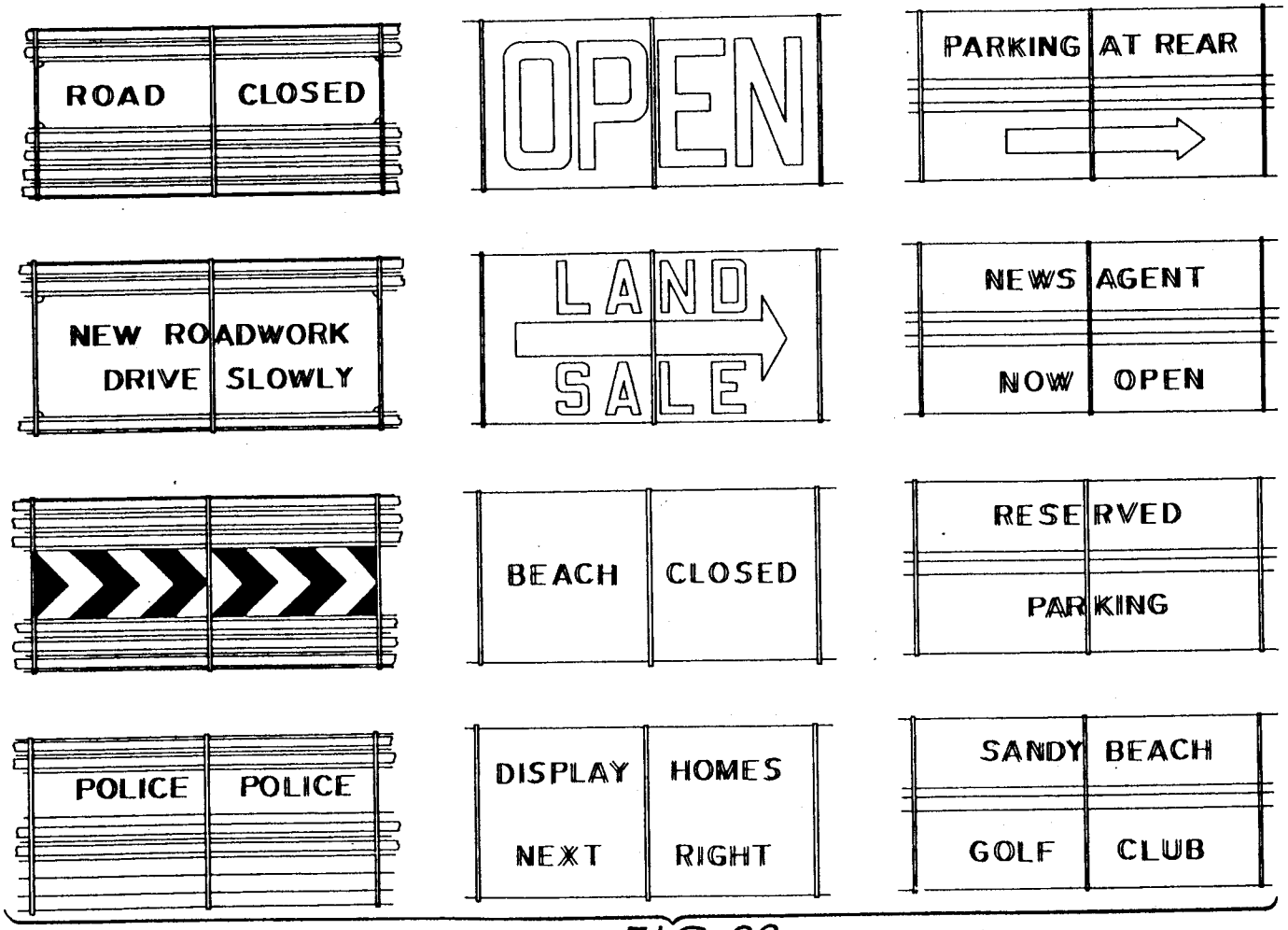
Figure 23:
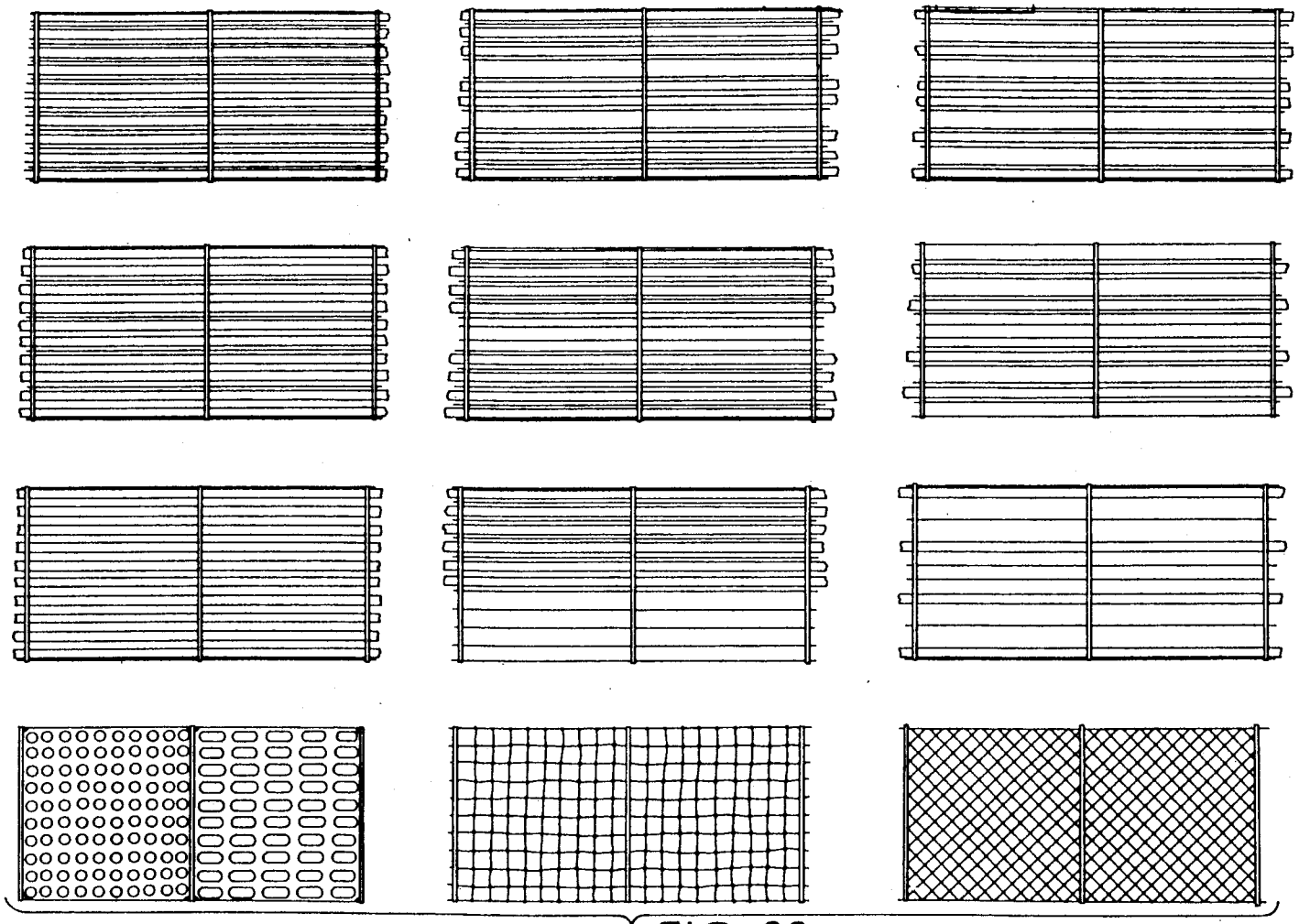
Figure 24:
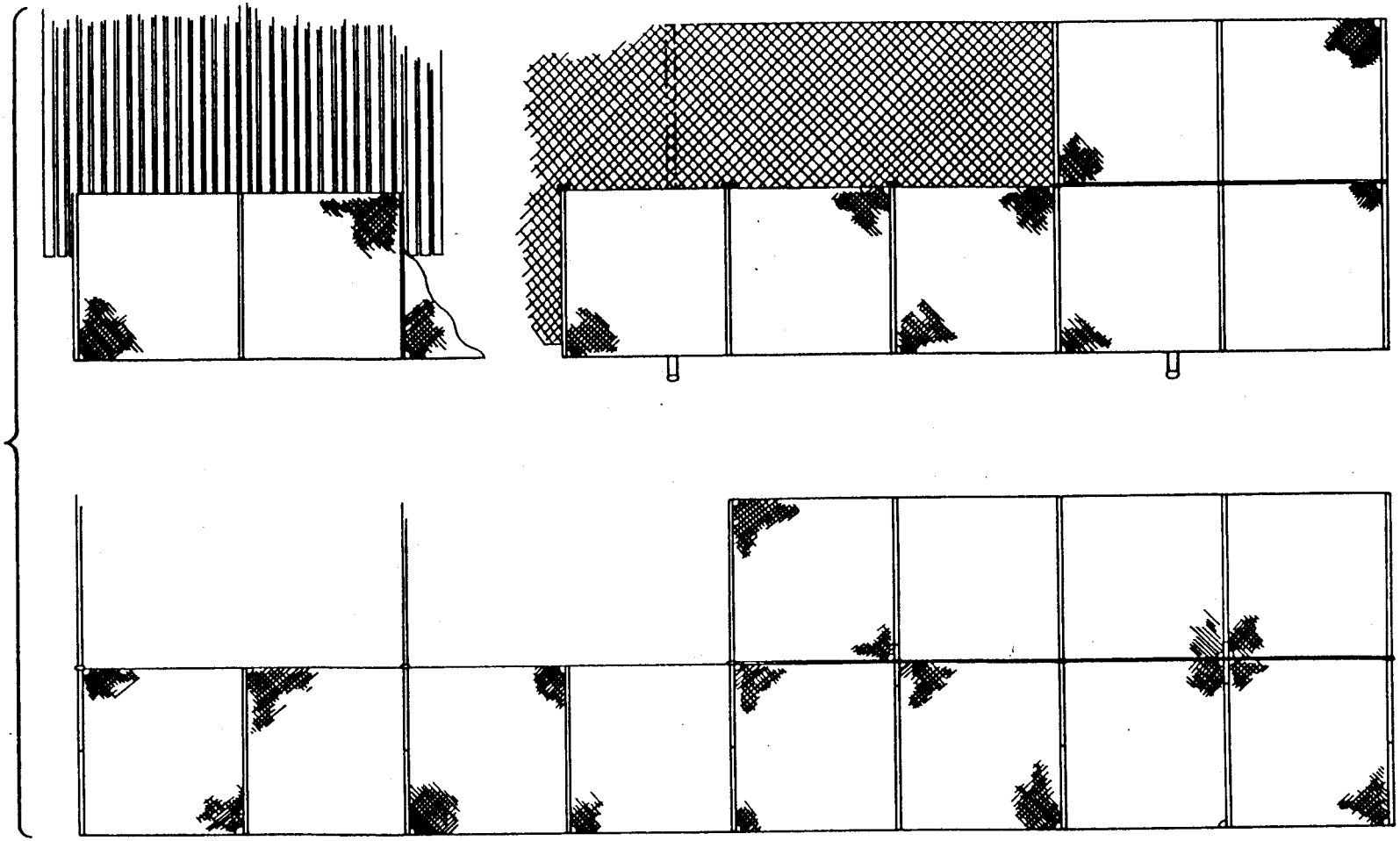
Figure 25A:
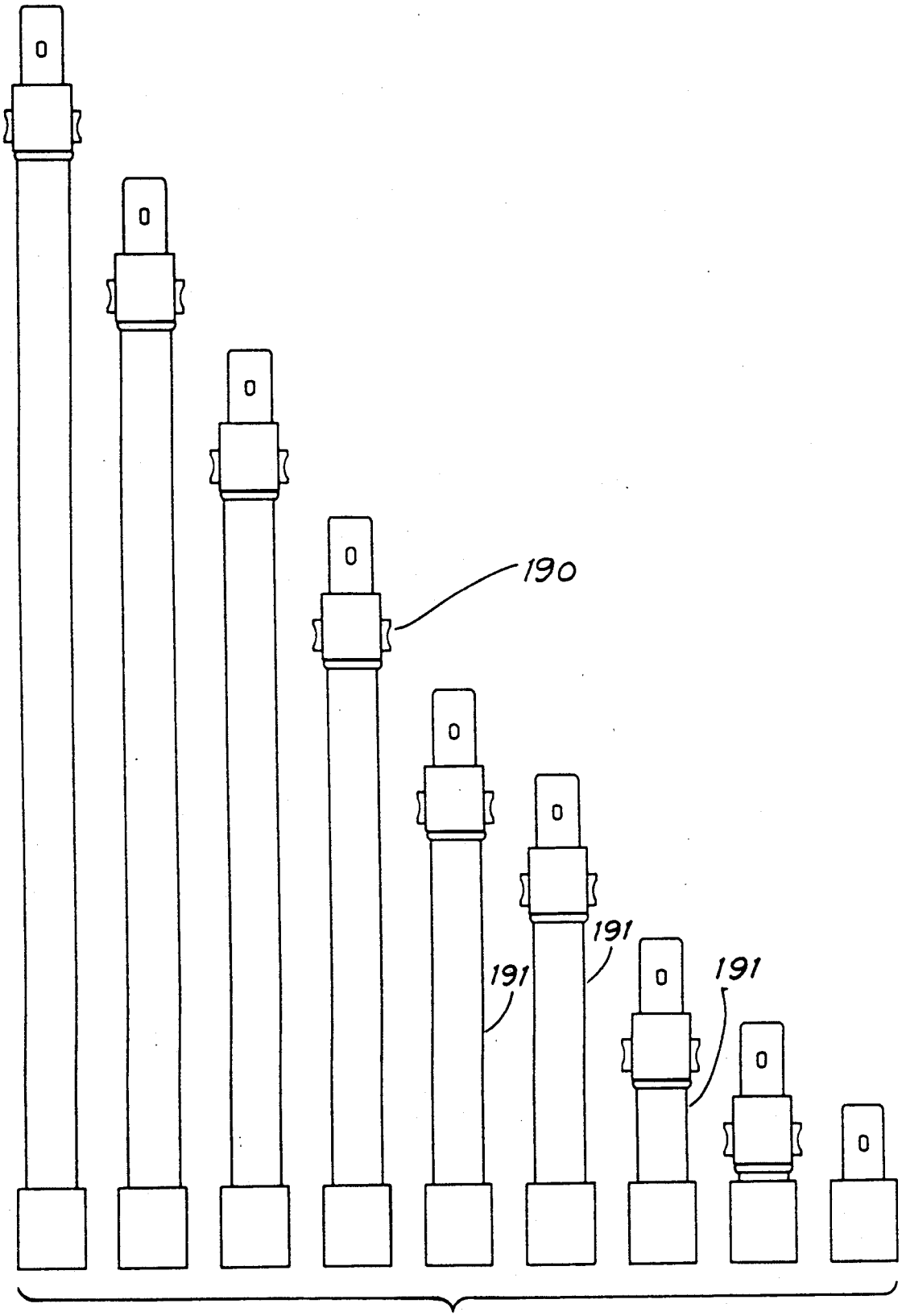
FIG. 25 shows various components for extending the height of the basic barricading embodying the invention.
Figure 25C:
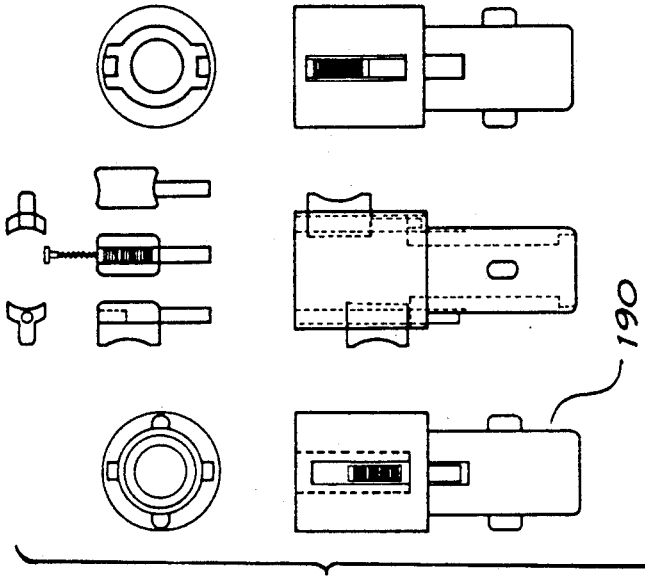
Figure 25B:
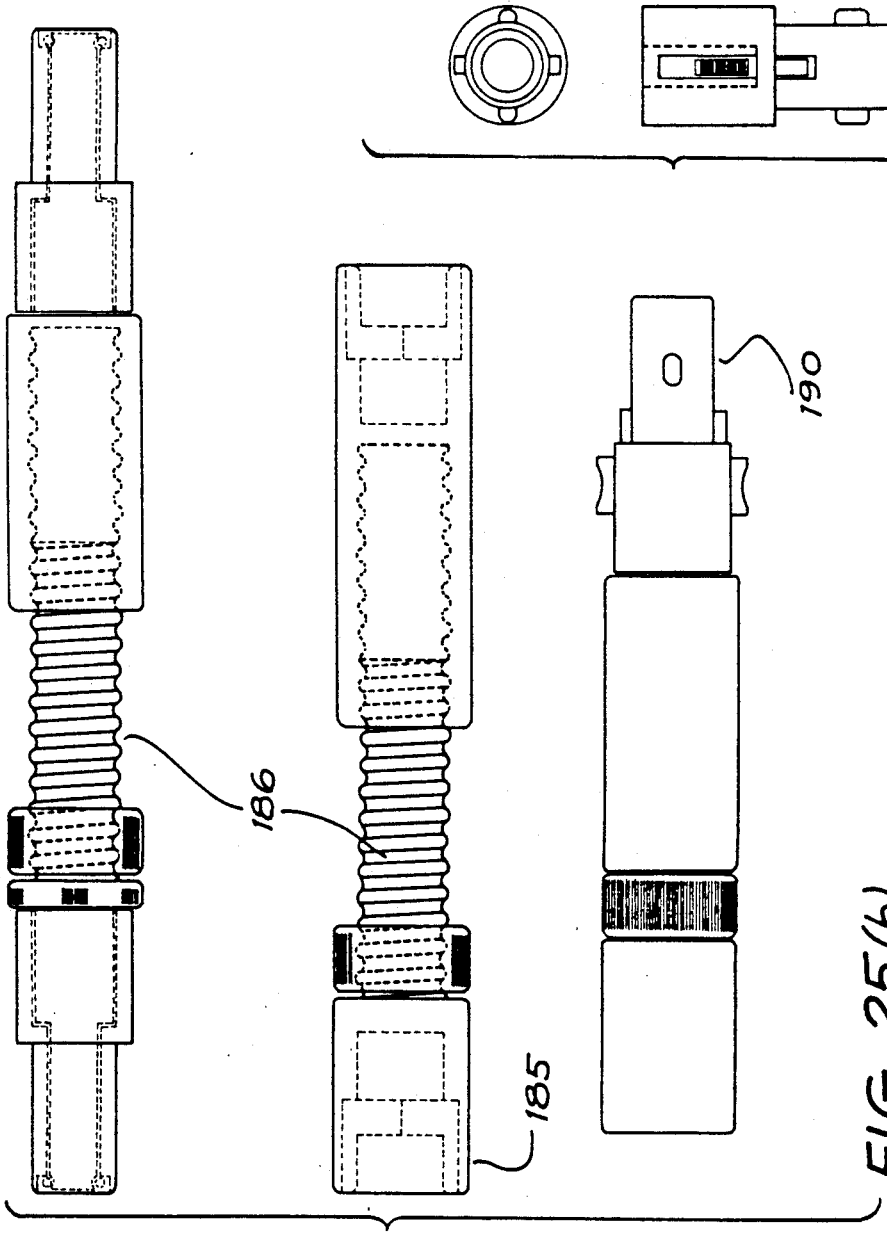
Figure 25D:
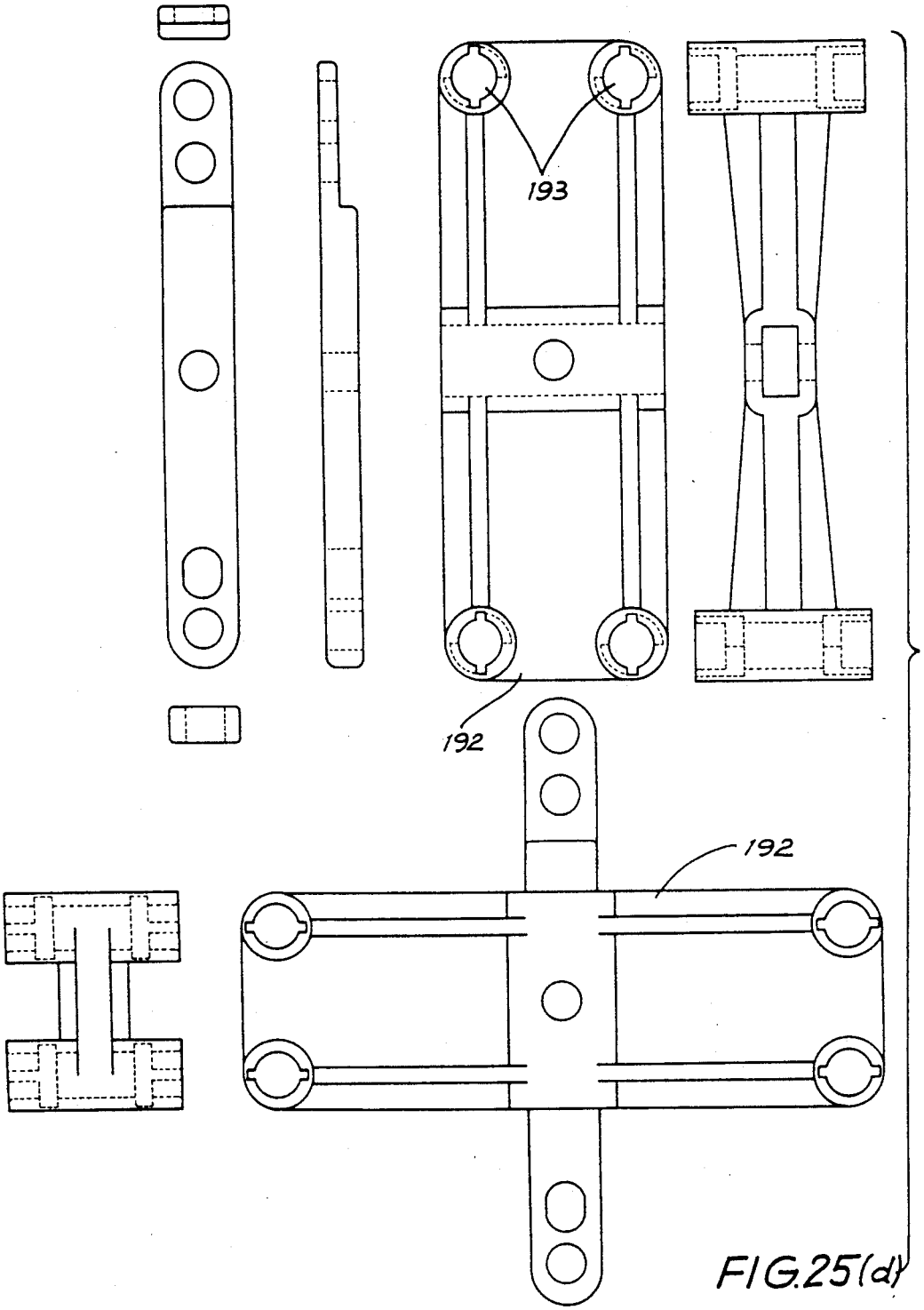

Various examples of uses of the invention to create signs, barricades or fences are shown in FIGS. 21–24. FIGS. 21–23 are self-explanatory while FIG. 24 shows a fence or barricade made of a double height. The dimensions of the barricading are variable but the material is conveniently made to be 1 meter high with tubes 21 or post stiffener straps 50 every metre of length.

To make the barricading of double height as shown in FIG. 24 the components shown in FIG. 25 can be used. These include a post extension having a key lock 190 at one end of a shaft 191 as shown at FIG. 25(*a*) with the detail of the key lock 190 being shown at FIG. 25(*c*); an adjustable extension which can be provided with a key lock 190 or a female socket 185 at either end of screw threaded piece 186; and extension support 192 provided with sockets 193 for fixing other elements of the system e.g. of FIGS., 12, 14–20.

In the embodiment shown with respect to FIGS. 7–20 the clips are preferably of 20 or 30 mm diameter and fixed to the straps at manufacture, while the two halves of the straps instead of being secured with pins or dowels can be rivetted or plastic welded together about the flexible mat with some clips being added after manufacture to support accessories. Though the embodiments have been directed to the description of the use of the invention to make fencing or barricades i.e. vertically oriented constructions this is not to be understood as a limitation. The invention can also be used to make constructions of other orientations, for example horizontal (as in shade enclosures) or inclined (as in an awning).

The components of the equipment described may be fabricated largely from materials available cheaply and in quantity, in particular by the use of standard PVC fittings. The invention is thus capable of considerable economy in manufacture as well as use.

While the invention has been described in relation to particular embodiments, it will be appreciated that other forms of the invention are possible, and the scope of the invention is not to be taken as being limited in any way by the particularity of the foregoing description.

I claim:

1. A roll of flexible material for use as a fence or barricade including an integral indeterminate length of flexible material, a plurality of strap means for stiffening said length of flexible material fixed to either side of said flexible material at first intervals along said length, each of said strap means extending across the width of said length of flexible material, and a plurality of means attached to and at irregular intervals along selected ones of said strap means for fixing said length of flexible material to supporting means at second intervals along said length of said flexible material in use.

2. A roll of flexible material as claimed in claim 1 wherein said strap means are fixed to both sides of said flexible material.

3. A roll of flexible material as claimed in claim 2 wherein said fixing means comprises spring clip means.

4. A system for handling and supporting a sheet of flexible material including an integral indeterminate length of flexible material for use as a fence or barricade, a plurality of strap means for stiffening said length of flexible material fixed to either side of said flexible material at first intervals along said length, said strap means extending across the width of said length of flexible material, a plurality of means attached to and at irregular intervals along selected ones of said stiffening strap means for fixing said length of flexible material to support means at second intervals along said length of said flexible material in use, wherein said stiffening strap means comprises straps fixed to either side of said flexible material traversely of said length and said fixing means comprises spring clip means attached at intervals along said straps, and dispenser means for storing said length of flexible material in a rolled form, said dispenser means including cartridge means having an axle member upon which said length of flexible material is wound.

5. A system for handling and supporting a sheet of flexible material as claimed in claim 4 wherein said dispenser means further comprise a casing having an aperture in a side of said casing for ingress and egress of said length of flexible material, said axle member having means for rolling up or unrolling said length of flexible material.

6. A system for handling and supporting a sheet of flexible material as claimed in claim 5 with said dispenser means further including locking means having a locking position to prevent said flexible material from being unrolled from or rolled upon said axle member and a free position enabling said flexible material to be unrolled from or rolled upon said axle member.

7. A system for handling and supporting a sheet of flexible material as claimed in claim 6 further including means to support said flexible material when unrolled at second intervals along a surface, each of said supporting means including a base portion and a post portion attached to said base portion with means carried by said post portion to co-operate with said fixing means to hold said length of flexible material in a given relation to said surface.

8. A system for handling and supporting a sheet of flexible material as claimed in claim 7 further including arm means to brace said supporting means.

9. A system for handling and supporting a sheet of flexible material as claimed in claim 8 further including means for securing said base portion to said surface and wherein said base portion comprises two halves hinged together.

10. A system for handling and supporting a sheet of flexible material as claimed in claim 9 wherein said supporting means comprises a float.

11. A system for handling and supporting a sheet of flexible material as claimed in claim 10 wherein said post portion further include extension means to enable the height of said post portion to be extended.

* * * * *